US006003982A

United States Patent [19]

Curley

[11] Patent Number: 6,003,982

[45] Date of Patent: Dec. 21, 1999

[54] DISPOSABLE INK CARTRIDGE RECHARGE SYSTEM

[76] Inventor: Charles M. Curley, 120 Brook Way, Ithaca, N.Y. 14850

[21] Appl. No.: 08/946,521

[22] Filed: Oct. 7, 1997

[51] Int. Cl.[6] ..... B41J 2/175

[52] U.S. Cl. ..... 347/85

[58] Field of Search ..... 347/84, 85, 86; 138/106, 120

[56] References Cited

U.S. PATENT DOCUMENTS

| | | | |
|---|---|---|---|
| 3,583,732 | 6/1971 | Dennis | 285/293 |
| 4,677,448 | 6/1987 | Mizusawa et al. | 347/85 |
| 4,684,962 | 8/1987 | Hirosawa et al. | 347/85 |
| 4,757,331 | 7/1988 | Mizusawa | 347/85 |
| 5,137,524 | 8/1992 | Lynn et al. | 604/283 |
| 5,367,328 | 11/1994 | Erickson | 347/7 |
| 5,369,429 | 11/1994 | Erickson | 347/7 |
| 5,449,021 | 9/1995 | Chikama | 138/118 |
| 5,469,201 | 11/1995 | Erickson et al. | 347/85 |
| 5,473,354 | 12/1995 | Arquilevich et al. | 347/85 |
| 5,561,453 | 10/1996 | Shibata et al. | 347/85 |

FOREIGN PATENT DOCUMENTS 63-120655 5/1988 Japan .

*Primary Examiner*—N. Le
*Assistant Examiner*—Michael Nghiem
*Attorney, Agent, or Firm*—Brown, Pinnisi Michaels P.C.

[57] ABSTRACT

A disposable ink refill system includes a recharge cartridge that attaches to a conventional desktop inkjet printer. A host cartridge unit, which includes a translating inkjet cartridge and an attached umbilical assembly, is fluidly connected to the recharge cartridge. The umbilical assembly easily attaches and detaches from the recharge cartridge to facilitate quick and easy exchange of the ink recharge cartridge, thereby providing a significantly less expensive alternative to ink cartridge replacement. The host ink cartridge unit, which has a useful life exceeding its ink capacity, is refilled instead of replaced, thus lowering a user's costs. The docking platform is integrated into the printer chassis, thus further facilitating quick and easy coupling of the umbilical assembly to the recharge cartridge. A docking platform, attached to the printer, provides the interconnection between the recharge cartridge and the host cartridge unit. An umbilical suspension is self-supporting, thereby resulting in a significant reduction in the printer footprint.

7 Claims, 28 Drawing Sheets

Pos #1 unsupported length = $k_2$ + x
Pos #2 unsupported length = $k_2$ + x/2

Stiffness Comparison of Strip Sectional Shapes

Figure 23
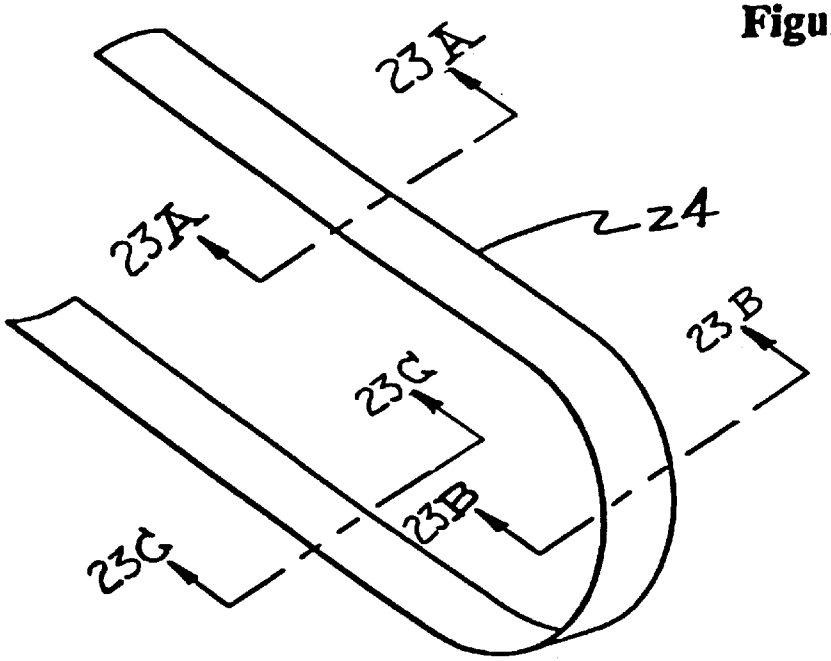
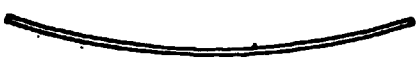
Figure 23C
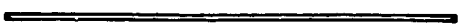
Figure 23B
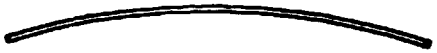
Figure 23A

DISPOSABLE INK CARTRIDGE RECHARGE SYSTEM

FIELD OF THE INVENTION

The invention pertains to the field of ink jet printers. More particularly, the invention pertains to a replaceable ink reservoir and umbilical supply for flowing the ink to an inkjet cartridge in a printer designed for use with a small computer.

BACKGROUND OF THE INVENTION

A fundamental consumer issue in inkjet printing is the cost of replacement ink cartridges. While the retail prices of inkjet printers continue to erode, the per page cost of the ink replacement cartridges makes inkjet the most expensive of all the available desktop printing technologies.

The inkjet printer manufacturers have chosen to provide disposable inkjet cartridges which combine the electronically actuated nozzles with a small ink reservoir. This approach is justified by the fact that the "nozzles" have a limited life and must be periodically replaced. However, practice has shown that the volume of ink provided by the small reservoir in the disposable cartridges, is meager in comparison to the potential life of the nozzles, and that the volume of ink provided is limited for reasons other than nozzle life.

There exists technical ability to provide larger capacities of ink, and there is also economic incentive to provide replacement ink at more reasonable cost by leveraging the life of the nozzles. Thus, an aftermarket industry has evolved with the goal of providing more economical ink refilling options for inkjet printers. Many innovative means have been derived for refilling the existing inkjet cartridges or retrofitting larger reservoirs to the existing inkjet cartridges. Other approaches provide a second ink reservoir of larger volumetric capacity, usually in a stationary orientation, that transmits ink to the smaller reservoir of the translating ink cartridge. The process of interconnecting to the stationary reservoir has been accomplished in an intermittent fashion by parking the translating ink cartridge at an injector or pumping station for recharging. Alternatively, the stationary reservoir may be continuously connected to the translating ink cartridge by means of a flexible umbilical conduit and thus continuously recharge the smaller reservoir of the translating ink cartridge by utilizing either atmospheric or subatmospheric pressure differential. Both reservoirs in these dual reservoir systems must be recharged periodically, but at different intervals.

The most economic dual reservoir solutions take the form of extending an umbilical ink flow tube from the translating ink cartridge to a remotely located stationary reservoir. In such cases, the stationary reservoir may take the form of a disposable tank which can be exchanged several times during the useful life of the translating ink cartridge. In this way, the original nozzles of the manufacturer's inkjet cartridge can remain resident in the printer over the life of several exchanges of the remote tank. Since the stationary reservoir does not bear the expense of the electronics and nozzles of the resident inkjet cartridge, the stationary reservoir can be manufactured more economically and made available at considerably less expense. In this way, more reasonably priced consumables can be made available to the users of inkjet printers.

Such dual reservoir systems presently exist in industrial inkjet printer applications, but are noticeably absent amongst the array of desktop inkjet printers that are used in conjunction with personal computers in the office and home environments. There are three (3) problems that have precluded the use of dual reservoir configurations in such inkjet printers:

1) spatial inefficiency, 2) cumbersome umbilical detachment means, and, 3) costly umbilical configurations.

The spatial efficiency problem stems from the difficulty in integrating the umbilical and stationary reservoir into the printer chassis configuration in a compact manner. Provisions for the path and suspension of the umbilical and relative spatial requirements for the stationary reservoir usually mandate larger printer dimensions. Conversely, the quest for a smaller printer "footprint" is a major competitive factor in the desktop printer market which consequently distracts manufacturers from the consideration of a dual reservoir configuration. The ability to quickly and easily exchange the stationary reservoir is also required if such dual reservoir systems are to appeal to consumers. This quick change feature can only be achieved if the umbilical is also easily detachable and manageable without entanglement or ink leakage. Finally, the umbilical assemblage must be implemented in a simple and economic way that can render it disposable along with the inkjet cartridge.

The task of connecting a tubular liquid ink conduit between a translating ink cartridge and a non-moving supply reservoir is easily understood as shown by the prior art. However, it is a much more difficult task to integrate the path and motion of the conduit into a compact printer configuration. The detailed tasks of supporting, suspending, guiding, and controlling the path of the conduit is a serious engineering challenge. These tasks are even more acute problems when the goal of the configuration is to provide a disposable ink supply reservoir and a disposable inkjet cartridge, both of which are quickly and easily exchangeable.

It is important to recognize the mechanics of the umbilical loop motion in order to appreciate its inherent geometry problems. In FIG. 1, a gravity-oriented umbilical is shown attached to and extending from the left of a translating ink cartridge. The ink cartridge and umbilical are shown in two positions which might represent the width of the recording zone for the ink cartridge or some other boundary. The three essential elements of the umbilical include an unsupported upper portion extending leftward from the ink cartridge, a loop which traverses in the direction of the ink cartridge, and a lower supported segment that can be attached to a stationary reservoir. A marker m represents a point on the umbilical and shows the track of that point as the umbilical unrolls during the inkjet cartridge translation. The lower region of the umbilical is maintained in a flat shape because it is supported by a structural frame member which is straight. However, the upper section of the umbilical is not supported, and thus cannot be maintained in a straight orientation because of its flexibility. Note that the addition of a stationary support for the upper umbilical section would block the motion of the translating print cartridge and is thus impractical.

This unsupported upper umbilical portion takes the shape of a mathematical curve called a catenary. A catenary is known as the curve in which a flexible cable or cord will hang when supported at its two ends. The height of the catenary (y) at any position (x) along its span can be computed from the fundamental relation $$y = a\left(\cosh\left(\frac{x}{a}\right) - 1\right)$$

where $a=T_h/w$, $T_h$ is the horizontal component of the umbilical tension, and w is the weight per unit length of the umbilical.

The height of the loop, as shown by $h_1$ and $h_2$ in the two positions, is dependent upon the weight of the unsupported span of umbilical to its right, and the bending moment of the umbilical across the loop. The two vectors $F_1$ and $F_2$ are in equilibrium at any position of the umbilical where $F_1$ represents the vertical reaction to the bending moment and $F_2$ represents the left reaction component due to the weight of the unsupported span. As the ink cartridge moves leftward, the loop portion of the umbilical translates at a rate of one half the rate of travel of the ink cartridge.

The total motion of the loop would equal one half that of the ink cartridge ($x_1$) if the radius of the loop would remain constant. However, the unsupported length of the upper umbilical decreases as the ink cartridge moves leftward. This reduces the length of the unsupported span and thus reduces the vertical umbilical weight component ($F_2$). The result is less opposition to the bending moment of the umbilical, such that height of the umbilical ($h_2$) is larger when the ink cartridge is at its left boundary. The traverse distance of the loop is thus only approximately equal to one half of the ink cartridge excursion, because the radius of the loop can be expected to gradually change as the ink cartridge traverses. This diagram also shows that a significant amount of space is required for the umbilical travel in the spatial region existing to the left of the leftward boundary of the ink cartridge excursion.

U.S. Pat. Nos. 4,677,448 and 4,757,331 (Mirusawa et al.) teach that control of the flexible conduit is a serious problem in configuring an appropriate printer structure. This prior art teaches that "it is required to reserve a large space for the flexible tube to move without trouble" and "since the tube is flexible, the locus of movement is not fixed but somewhat variable". "This large space dedicated to the movement of the flexible ink conduit has prevented the construction of smaller printers." For these reasons, the invention of Mizusawa et al. elected not to use an umbilical ink connection, but instead to provide an injection station. With this methodology, the translating ink cartridge is not connected to the stationary ink reservoir during the normal translation of the ink cartridge while printing or recording. Instead, the translating ink cartridge is transported to an injection station at certain intervals based upon ink exhaustion criteria, whereupon it is parked adjacent to an injector and pump which actively injects liquid ink from a larger volume ink reservoir. Such a configuration suffers the cost burden associated with pumps and injectors, as a result of not realizing a novel means for providing a more compact umbilical arrangement.

U.S. Pat. No. 5,473,354 (Arquilevich et al.) demonstrates a fundamental umbilical spatial problem as shown in FIG. 2. The umbilical assemblage is oriented in the plane of gravity underneath the translating ink cartridge and supported by a stationary frame member. The invention claims to "prevent the unwanted twisting of the fluid delivery tubes outside their vertical planes during carriage motion". This patent explains the obvious translation of the umbilical loop as the printhead traverses laterally, but does not show the orientation of the umbilical loop to the path of the printed media. Also noticeably absent is the identification and description of the relative orientation of the inkjet cartridge nozzles.

Current practice shows that the nozzles of inkjet printheads are oriented on the lower surface of the inkjet cartridge body in both atmospheric and subatmospheric type configurations. The term "lower surface" is interpreted in respect to gravity. The reasons for this are obvious and also include the need for gravitational support of the printed media in the gap adjacent to the nozzles. This printhead orientation causes a significant problem if the umbilical loop must also operate in the plane of gravity (vertical plane). In such cases, the umbilical must have sufficient length and travel in its operating plane, to prevent the loop from cutting across the plane of the media, as shown by the illustration in FIG. 3. The operational zone of the loop must exist leftward of the media path and requires a width equal to about one half that of the printhead excursion zone plus some spatial clearance for the loop. The umbilical operational zone is shown in FIG. 3 by the dimension ($k_1$+x/2). This illustration thus explains that the printer chassis would need to include provision for the significant extra space that is required for the motion of the umbilical loop. A printer which used this umbilical configuration would require at least a 50% wider footprint than the same printer without an umbilical.

It can be seen that the gravity-oriented umbilical suspension is not amenable to the goal of providing a compact desktop printer. The explanation in Arquilevich et al. teaches that spatial efficiency was not a goal of this arrangement, stating that "the actual length and configuration of the apparatus is not important provided that the ink-delivery tubes are sufficient to connect one or more ink sources to the moveable printhead".

U.S. Pat. No. 5,561,453 (Shibata et al.) is another example of the prior art which teaches an umbilical loop translation but fails to explain the relative orientation of the media path.

U.S. Pat. No. 4,684,962 (Orosawa et al.) shows an umbilical shape in FIG. 4 that more appropriately illustrates the shape of those actually found in practice. This prior art also fails to disclose the relative orientation of the media path.

Other prior art seeks to solve problems which are the aftermath of inadequate umbilical control. Shibata et al. teaches a solution to the potential problem of the conduit being collapsed by a "kink" or entanglement, as shown in FIG. 5. A custom profile flexible ink carrying conduit contains multiple chambers to allow fluid ink flow when the primary chamber becomes restricted as a result of collapsing or kinking. This prior art does not, however, teach how to support, guide, suspend, or control the path of the flexible conduit so as to initially prevent the problems of collapsing or kinking.

Arquilevich et al. teaches a solution to bundling groups of flexible tubes in the situations where multiple ink supply conduits are utilized, as in the case of multicolor printer devices. As show in FIG. 6, a thin membrane material is bonded over the periphery of several circular tubes such as to interconnect the individual tubes into a common structure which will prevent entangling. Hirosawa et al. also teaches a multiple conduit approach to help manage the movement of the flexible ink supply interconnections. The two tubes are made to move in parallel to each other by virtue of their exit orientation relative to the traversing ink cartridge carrier structure. However, neither Arquilevich et al. nor Hirosawa et al. proposes a solution to the case where only a single ink conduit is utilized. Furthermore, none of these inventions seeks to explain a solution to the problem of guiding, suspending or controlling the path of the flexible conduit assemblage. Nor does this prior art seek to minimize the spatial requirements of the umbilical.

U.S. Pat. No. 3,583,732 Dennis et al.) discloses a helically wrapped wire spring to enshroud and support a fluid (air)

duct, and thus prevent the collapsing of the internal cavity of such a duct. Longitudinal wires are attached along the peripheral axes of the duct to render the duct inflexible. This arrangement lacks flexibility and would thus not be suitable for the task of providing a flexible conduit from a stationary reservoir to a translating ink cartridge.

U.S. Pat. No. 5,449,021 (Chikama et al.) teaches the use of a helically wrapped spring in conjunction with control wires, to provide a controlled flexible conduit motion in one plane. Corrugated metal strips are spot welded to the periphery of the helix along the longitudinal axis of the spring on two opposing sides as shown in FIG. 7. The helices along two sides of the spring are thus rendered inflexible in the plane formed by the two spot welded strips. Two control wires are threaded through the internal cavity of the conduit and terminated at the flexible end of the structure at positions which are orthogonal to the spot welded bands. Rotation of a pulley in the control end of the conduit then pulls one of the wires to create limited flexure in one plane. This technique is a complex and costly solution to the problem of providing a conduit that is flexibly controllable in one axis only. Such complexity and cost precludes its utilization in a disposable and economically sensitive inkjet cartridge application.

Many methods for interconnecting flexible liquid carrying conduits have been shown in the prior art, including those that clamp needle-like probes to a septum. U.S. Pat. No. 5,137,524 (Lynn et al.) shows a sliding collar to clamp a probe, which contains a needle, to the exterior surface of a septum after the needle has penetrated the septum. This is shown in FIG. 8. While this invention presents a means to couple two sections of flexible conduit, it does nothing more than provide a system of two possible states consisting of either a coupled or uncoupled flexible conduit. In the first, or coupled state, there exists a connection between the remote liquid reservoir and the receiving end (patient's vasculature), but little control over the suspension and path of the flexible conduit. In the second, or uncoupled state, the control of the conduit is lost completely.

The lack of a docking station, and lack of means to control the umbilical assemblage, are deficiencies which prevent earlier invented stationary reservoir systems from presenting a quickly exchangeable reservoir or a quickly changeable translating ink cartridge.

U.S. Pat. Nos. 5,369,429 and 5,367,328 (Erickson et al.) show stationary reservoir ink delivery systems where ink is delivered through one or more flexible tubes to translating ink cartridges. The individual tubes are affixed to cavities in the individual links of a link chain which provide the support elements for an umbilical assembly. At the reservoir end of the flexible tubes, the tubes enter the stationary reservoirs through an orifice which is both strain relieved and sealed to a plastic reservoir liner, such that the tubes are a permanently and inextricably attached to the remote reservoirs. FIG. 9 shows this reservoir and ink cartridge without the link chain. The process of exchanging the remote tank then requires that the tubes be individually unthreaded and rethreaded through the individual clamping stations of the chain link umbilical assemblage. Before such threading can take place, the support chain itself must be detached from the printer structure. The tedious nature of this threading and unthreading process, combined with the lack of an umbilical docking station, prevents the possibility of providing a quickly exchangeable reservoir.

Other prior art proposes to operate the umbilical in a plane that is perpendicular to the plane of gravity. U.S. Pat. No. 5,469,201 (Erickson et al.) presents two solutions to constraining the movement of an umbilical to one plane of motion. A preferred solution is highly flexible but unstable, while an alternate solution is excessively inflexible. In the prior art preferred embodiment shown by FIG. 10, plastic link chain is utilized as a flexible umbilical carrier and looped into a plane which is orthogonal to its hinge pins, such that it is self supporting in that particular plane. However, while the link chain is constrained to that plane, its movement within that plane is not predictable. This problem is resolved by the addition of a flat metal band which is mounted adjacent to and along the periphery of the link chain to aid in controlling the shape of the loop. The result is an umbilical assemblage that is self supporting in one axis which is perpendicular to the axis of gravity, but flexible in the other two axes. This umbilical assemblage can only be self-supporting when arranged within the printer configuration such that the axis of the chain link hinge pins is oriented within the axis of gravity. This restriction then presents an impediment to providing a compact printer configuration, as the plane of the looped umbilical cannot exploit a more vertical orientation. A more vertical umbilical orientation is a requirement to position the reservoir as closely as possible to the path of the translating ink cartridge, and thus to provide a compact printer configuration as shown by the invention herein. Further, since this combination of link chain and flat metal band is complex and costly, it precludes the possibility of providing an economically disposable umbilical.

An alternate embodiment of Erickson et al. '201 is explained which uses a "unitary piece of rigid, flexible material" that is described and shown as being in the shape of a rectangular channel made of plastic or metal. The channel carries a series of attachment mechanisms, which are spaced intermittently at 3 to 4 inch intervals along the length of the channel, and whose purpose is to support the ink supply tubes. Each of the individual attachment mechanisms supports a "closure used to secure the supply line", which is further described as a "pivoting clamp mechanism". The structure and operational principles of the "pivoting clamp mechanism" and the means for attaching it to the channel, are not disclosed. The elongate channel is further described as maintaining a "generally U-shaped" structure and is diagrammatically shown as maintaining its cross sectional channel shape continuously without deformation, around a 180 degree bend with a smooth radius. Two views of this channel and its ink tubes are shown in FIGS. 11 and 12.

The stiffness attributes of a structure, or conversely its flexibility attributes, are composed of two factors; shape and material composition. Any given material possesses a characteristic property called its elastic modulus, that uniquely dictates the degree of flexibility that a given shape can achieve when utilizing that particular material. For example, a 2"×4" wooden stud made of Douglas fir such as used in residential building construction (a common two-by-four) can be compared in stiffness to a 2"×4" stud which is made of steel. The Douglas fir possesses an elastic modulus of 1.9 million psi and the steel possesses an elastic modulus of 30 million psi. Thus, the steel stud is stiffer than the wood stud due to its significantly higher elastic modulus. The actual difference in stiffness between the two studs can be computed by simply comparing the ratio of elastic moduli. When checking this ratio, we can conclude that the steel stud will be exactly 15.79 times stiffer than the wooden stud. Conversely, we can also conclude that the wooden stud is 15.79 times more flexible than the steel stud. Thus it can be seen that a homogeneous material possesses a unique property, its elastic modulus, that quantifies its inherent flexibility regardless of shape. The description of a material that is both rigid and flexible, as explained in Erickson et al (U.S. Pat. No. 5,469,201), is therefore clearly a self-contradiction.

More important to the issue of flexibility is the shape of the cross section of a structural member. In the field of structural mechanics, a characteristic number can be computed for any shape that inherently predicts how flexible that shape will be when subjected to forces which are imposed along different axes. That property is known as the moment of inertia of a sectional shape. Unlike materials, shapes in themselves can be inherently flexible or inherently inflexible by virtue of this property. Further, the moment of inertia is axis-dependent such that a given shape may have a moment of inertia that can be different in one axis than in another. An example of this can be easily understood from analyzing a thin flat metal strip.

For this example, assume that the goal was to make a thin strip that was to be very flexible. Common sense would dictate a shape with a high ratio of width to thickness. As an example, the dimensions of ½" for the width and 10 mils for the thickness might be chosen, which are similar to the dimensions of a small metal ruler. The ratio of width to thickness is 50:1 in this case. The moment of inertia for this rectangular shape along its bending axis can be easily computed from the equations of structural mechanics, which are found in most engineering handbooks. The results of such a computation yields a moment of inertia of $0.041\times 10^{-6}$ $in^4$ as shown below.

Moment of Inertia for a Thin Rectangular Section (across thickness)

Referring to FIG. 3A, $I=wt^3/12$, where I=moment of inertia ($in^4$). Since w=0.50 and t=0.01, $I=(0.50)(0.01)^3/12$, and $I=0.041\times10^{-6}$ $in^4$.

Alternatively, the moment of inertia of the strip could be computed for the direction across its width. The results of that computation yields a section modulus of $104.166\times10^{-6}$ $in^4$ as shown below. These results show that the strip is tremendously more stiff across its width than it is across the plane of its thickness and explains why the strip is rigid in that plane. The stiffness of the strip in each of the two planes can be compared by taking the ratio of the moments of inertia in the two planes. This shows that the strip is 2,540 times stiffer in the width direction than in the thickness direction, irrespective of the material that is utilized. This explains why large ratios of width to thickness are chosen in the case where both lateral stability and a high degree of flexibility are required, such as in the cases of power transmission belts which must wrap around pulleys.

Moment of Inertia for a Thin Rectangular Section (across width)

Referring again to FIG. 3A, $I=tw^3/12$, where I=moment of inertia (in4). Therefore, $$I=(0.01)(0.50)^3/12 \text{ and}$$

$$I=104.166\times10^{-6}\ in^4.$$

Assume that this strip was deemed "too flexible" for a given application, and that the shape should be modified in order to make the strip more structurally rigid. One way to achieve more rigidity is to add a "stiffening rib" projecting perpendicular to the thin section of the strip, such that the shape of the strip looks like a "T" section. The data below shows the quantified increases in stiffness for added sections of various ratios of the strip width. For example, a flange depth of 20% of the strip width produces an 82.9 times stiffness increase, so that the strip is no longer easily bendable.

Moment of Inertia for a "Tee" Section

Referring to FIG. 3B, $y=(f+t)-[(f^2+2tf+wt)/(2w+2f)]$ in and $$I=1/3[ty^3+w(f+t-y)^3-[(w-t)(f-y)^3]]\ in^4$$

where I=moment of inertia (in4) and y=distance to neutral fiber (in).

For the comparative case where flange depth=20% of beam width, w=0.50=width of the beam (in), f=0.10=height of the beam (in), and t=0.01=section thickness (in), substituting yields:

$$y=(0.1+0.01)-[((0.1)^2+(2)(0.01)(0.10)+(0.5)(0.01))/((2)(0.5)+(2)(0.10))]\ in$$

$\therefore y=0.095833$ in and $$I=1/3[(0.01)(0.095833)^3-(0.5)(0.10+0.01-0.095833)^3-[(0.5-0.01)(0.10-0.095833)^3]]\ in^4$$

$\therefore I=3.40\times10^{-6}\ in^4 \leftarrow$

In like manner, comparative moments of inertia are computed for the cases of 10% and 30% flange-to-width ratios and shown in the following table:

| Sectional Shape | Moment of Inertia $in^4$ | Stiffness ratio |
|---|---|---|
| Thin rectangular | $0.041\times10^{-6}$ | 1.0 |
| "T" w/10% flange ratio | $0.555\times10^{-6}$ | 13.5 |
| "T" w/20% flange ratio | $3.40\times10^{-6}$ | 82.9 |
| "T" w/30% flange ratio | $10.20\times10^{-6}$ | 248.8 |

Another method that can be used to stiffen the strip is to add two "stiffening ribs" at the longitudinal edges of the strip, such that it cross section takes the shape of a channel.

The increase in rigidity due to the channel shape is also intuitively understood, but the examples below have been generated to quantify the increases in stiffness, for added sections of various ratios of the strip width. For example, a flange depth of 20% of the strip width produces a 147 times stiffness increase, as compared to the thin rectangular strip. The relative proportions of these shapes is shown in FIG. 13. It can be seen that the channel shape is an extremely effective stiffening shape, and produces more rigidity than the "T" shape, when using the same size envelope. This is the reason that the channel shape is commonly used for steel beams in the construction of commercial buildings.

Moment of Inertia for a Channel Section:

Referring to FIG. 3C, $y=(f+t)-[(2f^2+4tf+wt)/(2w+4f)]$ in and $$I=[2tf^3+6f^2t^2+6ft^3+wt^3]/3-[(f+t-y)^2(wt+2ft)]\ in^4$$

where I=moment of inertia ($in^4$) and y=distance to neutral fiber (in).

For the comparative case where flange depth=20% of beam width, w=0.50=width of the beam (in), f=0.10=height of the beam (in), and t=0.01=section thickness (in). Substituting yields $$y=(0.1+0.01)-[((2)(0.10)^2+(4)(0.01)(0.1)+(0.5)(0.01))/((2)(0.5+0.2))]\ in$$

$\therefore y=0.089286$ in and $$\therefore I=[(2)(0.01)(0.10)^3+(6)(0.10)^2(0.01)^2+(6)(0.10)(0.01)^3+(0.5)(0.01)^3]/3-[((0.10+0.01-0.089286)^2((0.5)(0.01)+(2)(0.10)(0.01))]\ \text{in}^4$$

$\therefore I=6.03\times10^{-6}$ in$^4$.

In like manner, comparative moments of inertia are computed for the cases of 10% and 30% flange-to-width ratios and shown in the following table:

| Sectional Shape | Moment of Inertia in$^4$ | Stiffness ratio |
|---|---|---|
| Thin rectangular | $0.041 \times 10^{-6}$ | 1.0 |
| Channel w/10% flange ratio | $1.0 \times 10^{-6}$ | 24.4 |
| Channel w/20% flange ratio | $6.03 \times 10^{-6}$ | 147.0 |
| Channel w/30% flange ratio | $17.70 \times 10^{-6}$ | 431.7 |

It can thus be seen that the rectangular channel shown by the alternate embodiment of Erickson et al. '201 is a structure that is inherently rigid, and thus difficult to bend whether it be made from plastic or metal. Since the forces required to bend such a structure must be continuously provided by the transport motor which translates the printhead, such motor will require considerable extra power for the task of continuously bending and unbending a channel structure during the translational printing process. This can be shown by the analysis below which compares the force required to bend a thin flat strip with those to bend a channel of the same thickness over onto itself into the shape of a loop.

The channel illustrated in the Erickson et al. '201 patent diagrammatically shows lateral flanges that are proportioned to the channel width by about a 20% ratio. It is understood that the embodiment is not limited to the channel proportions which are shown, but it is also clear that these proportions are intended to be instructional such that at least one desirable subset of the embodiment could be construed from the diagram. Thus, an understanding of the required forces to bend a channel of these proportions will help to understand the prior art. The comparative analysis that follows uses the case of a plastic channel proportioned with lateral flanges which are 20% of its beam width.

The force required to bend a column over onto itself can be calculated by the methodology of Baumeister and Sebrosky ("Finding Vertical Column Deflections", Machine Design, Oct. 19, 1972, p159, H. K. Baumeister and R. A. Sebrosky) which uses "dimensionless column factors" to compute the loads required for large vertical deflections of vertical columns. The case of bending a 10 mil thick plastic column over onto itself is used for this analysis, and assumes the use of acetal polymer, a plastic commonly utilized for applications which require repeated flexing.

Case 1 uses the cross section of the thin strip above as made from acetal, while Case 2 uses the same material and thickness, but adds the lateral sides to form a channel with a 20% ratio of flange depth to width. This analysis shows that the rectangular section will require a bending force of 0.043 pounds (less than an ounce), while the channel shape will require a bending force of 6.38 pounds to achieve the same looped configuration. For sake of comparison, the weight of the entire translating carrier assemblage on this printer is 7 ounces. The transport motor used with a channel-shaped ink tube carrier must then be considerably larger in horsepower and physical size, and then also much more costly, than the motor required to flex the comparable flat rectangular strip. The use of a channel-shaped ink tube carrier will then be contrary to the economy and compact size goals of the desktop printer configuration, and therefore must be avoided.

Analysis of the Bending Forces by the Baumeister and Sebrosky Method

Referring to FIG. 3D, the desired span across the loop= 1.3". For a 180 degree bend, x/L=0.4, or x=0.4L, but x=1.3" to satisfy the loop geometry. Therefore, 1.3=0.4L, or L=3.25" arc length around the bend.

For −90 degree slope at beam tip, DCF=5.19, where DCF=dimensionless column factor=L $\sqrt{(P/EI)}$.

Therefore, 5.19=3.25 $\sqrt{(P/EI)} \Rightarrow P/EI=(5.19/3.25)^2$ and P=2.550163 (EI).

For acetal, the elastic modulus $E=415\times10^3$ PSI. Substituting, we obtain P=(1,058,318) I lb/in$^4$.

| CASE 1: Rectangular strip | CASE 2: Channel |
|---|---|
| $I = .041 \times 10^{-6}$ in$^4$ | $I = 6.028 \times 10^{-6}$ in$^4$ |
| $\therefore P_1 = (1{,}058{,}318)(.041 \times 10^{-6})$ | $\therefore P_2 = (1{,}058{,}318)(6.028 \times 10^{-6})$ |
| $\therefore P_1 = 0.043$ lb = 0.7 oz | $\therefore P_2 = 6.38$ lb |

SUMMARY OF THE INVENTION

Briefly stated, a disposable ink refill system includes a recharge cartridge that attaches to a conventional desktop inkjet printer. A host cartridge unit, which includes a translating inkjet cartridge and an attached umbilical assembly, is fluidly connected to the recharge cartridge. The umbilical assembly easily attaches and detaches from the recharge cartridge to facilitate quick and easy exchange of the ink recharge cartridge, thereby providing a significantly less expensive alternative to ink cartridge replacement. The host ink cartridge unit, which has a useful life exceeding its ink capacity, is refilled instead of replaced, thus lowering a user's costs. The docking platform is integrated into the printer chassis, thus further facilitating quick and easy coupling of the umbilical assembly to the recharge cartridge. A docking platform, attached to the printer, provides the interconnection between the recharge cartridge and the host cartridge unit. An umbilical suspension is self-supporting, thereby resulting in a significant reduction in the printer footprint.

In contrast to the unstable or exceedingly rigid ink tube assemblages explained by the prior art, the invention herein has achieved a successful embodiment of a unitary umbilical spine that is both simple and structurally stable in all three axes irrespective of gravity. Its stability is achieved by employing a method of dynamically changing the cross sectional shape of the support from that of a radial shape in the non-loop portion of the suspension, to that of a thin rectangular cross section in the loop portion of the suspension. This is an ideal solution since there exists no other shape that is inherently more flexible than the thin, rectangular cross section. However, the unbent portions of the spine would benefit from a different cross sectional shape that would provide more rigidity. The only way that the stiffness of a unitary spine can be made different in the loop section than in the straight section, is to change the shape of the cross section. One novelty of this invention stems from the fact that the moment of inertia of the umbilical spine can dynamically alter itself as it enters and exits the loop section during the traversing motion of the printhead. This is achieved by exploiting the so called "diaphragm effect", whereupon a body possessing a given shape, if stressed beyond a certain limit will revert to an alternate shape. In this case, the bending stress induces the umbilical spine to change from a radial shape to the ultimately flexible flat shape, as it enters the traversing loop of the umbilical, and to change back to a radial shape as it exits the loop.

The present invention seeks to resolve the problems outlined in the above-noted prior art which have prevented the integration of disposable, economic ink refill systems into compact, desktop inkjet printers. The present invention relates generally to the fluid delivery system in inkjet printers that utilize dual reservoirs. The invention further relates to the compact and self-supporting construction of the umbilical ink delivery conduit and the cooperating structures that interact to easily attach and detach the umbilical assembly to the ink reservoirs in order to facilitate quick and easy exchange of the reservoirs.

More specifically, this invention seeks to provide means to continually refill a small, 40 cc reservoir within a translating inkjet cartridge, throughout a service life of 360 cc of ink, by connecting the inkjet cartridge to a larger disposable "recharge cartridge" which possesses an 80 cc reservoir of ink. The system provides the capability to periodically couple and uncouple the larger reservoir of the recharge cartridge to a conduit that conveys ink to the smaller reservoir of the "host cartridge unit". Four exchanges of the recharge cartridge are intended to be made during the service life of each host cartridge unit.

BRIEF DESCRIPTION OF THE DRAWINGS

FIG. 23 shows a perspective view of a flexible steel spine according to the present invention.

FIG. 23A shows a cross-section of the spine of FIG. 23 taken across the line A—A.

FIG. 23B shows a cross-section of the spine of FIG. 23 taken across the line B—B.

FIG. 23C shows a cross-section of the spine of FIG. 23 taken across the line C—C.

DESCRIPTION OF THE PREFERRED EMBODIMENT

Figure 14:
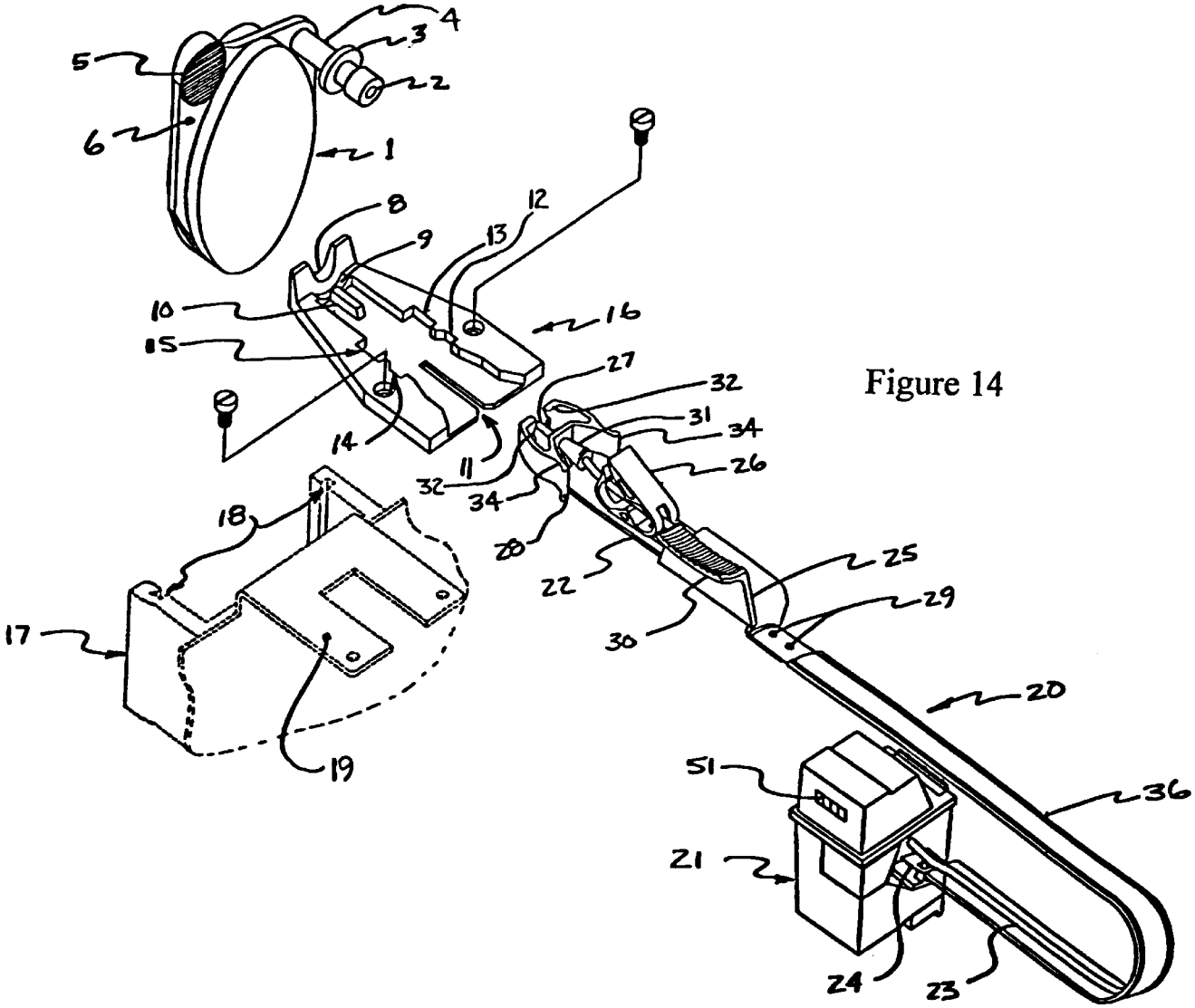
FIG. 14 shows an exploded perspective view of an embodiment of the present invention.

Referring to FIG. 14, the three fundamental elements of the disposable ink refill system for a desktop inkjet printer according to the present invention are shown. A recharge cartridge 1, preferably containing 80 cc of ink, is slideably mounted to a printer chassis receptacle 17. Recharge cartridge 1 contains a septum stem 4 which seats into a cooperating groove 8 in a docking platform 16. The docking platform 16 is permanently attached to the printer chassis 19, and is used to host the interconnect means for coupling the recharge cartridge 1 to a host cartridge unit 20, which is composed of a translating inkjet cartridge 21 and an attached umbilical assembly 36. The inkjet cartridge 21 possesses a smaller reservoir containing approximately 40 cc of ink. An ink carrying conduit 23 extends from the small reservoir of the inkjet cartridge 21, along the surface of a looped umbilical spine 24, and is terminated at a rigid needle-like probe 27. The probe 27 is mounted to a docking slide 22 which possesses latching and handling means for attaching to a docking platform 16. The docking slide 22 is slideably mounted to the docking platform 16 such that the probe 27 can penetrate the septum 2 of the recharge cartridge 1, thereby facilitating ink flow from the recharge cartridge 1 to the smaller reservoir of the translating inkjet cartridge 21.

The recharge cartridge 1 is slideably mounted into position in the inkjet printer by means of a stationary set of grooves 18 which are an integral part of the printer frame structure 17. Flanged surfaces 6 on the recharge cartridge 1 cooperate with these grooves to establish a stable lateral position. A cylindrical stem 4 extending from the recharge cartridge 1 possesses a tubular conduit to the ink chamber that is terminated by a soft elastomeric septum 2. An annular ring 3 located on the septum stem 4 is used to aid the guidance of the stem 4 into the tapered receiving slot 8 of the docking platform 16 The vertical position of the recharge cartridge 1 is established by the seating contact between the cylindrical stem 4 and the receiving slot 8 of the docking platform 16. The recharge cartridge 1 possesses a raised area 5 which is preferably grooved and contoured to fit between the thumb and forefinger of the human hand, so as to facilitate handling by the operator during the process of exchanging the recharge cartridge. The recharge cartridge is freely removable from the printer, or freely insertable into the printer, when the docking slide 22 is maintained in a retracted position which is removed from the vertical path of the septum stem 4.

The docking platform 16 includes a slot 11 which cooperates with two "T" shaped projections on the underside of the docking slide 22 during insertion of the docking slide 22 into the docking platform 16. Latch recesses 12, 13, 14, and 15 in the docking platform 16 interact with circular projections 28 on the docking slide 22 to lock the docking slide 22 onto the docking platform 16. A radial undercut 9 and a stress relief rib 10 are used to nest the annular ring 3 of the septum stem 4, such that the stresses arising from puncturing and extracting the probe/septum bond, are not transmitted to other parts of the printer.

The docking slide 22 is preferably made of rigid, injection molded plastic and is permanently attached to the flexible metal spine 24 by means of heat staked studs 29. The docking slide 22 possesses a projection 25 whose purpose is to provide a convenient gripping surface for use by the user during the process of exchanging recharge cartridges 1 or exchanging the host cartridge unit 20. The holding surface 30 is preferably contoured to fit the profile of the user's finger and possesses grooves to aid in gripping. The tubular section of the ink conduit 23 passes through a set of apertures in the clamp valve 26, and is then terminated to a rigid plastic coupling 31. The terminal end of this coupling possesses a narrow, tapered, hollow probe 27 whose purpose is to puncture the septum 2 of the recharge cartridge 1, and thus to facilitate flow of the ink through the conduit 23 to the chamber of the translating inkjet cartridge 21.

The docking slide 22 possesses two hooks 32 adjacent to the probe's leading surface 27, which are used to latch the probe 27 into the septum 2 of the recharge cartridge 1 by grasping a retaining groove 33 behind the stem of the septum 2. Integrally molded handles 34 are arranged such that a pinching action by the operator's fingers will release the hooks 32 from the retaining grooves 33 and thus allow the probe 27 to be retracted and disengaged from the septum 2.

Figure 15:
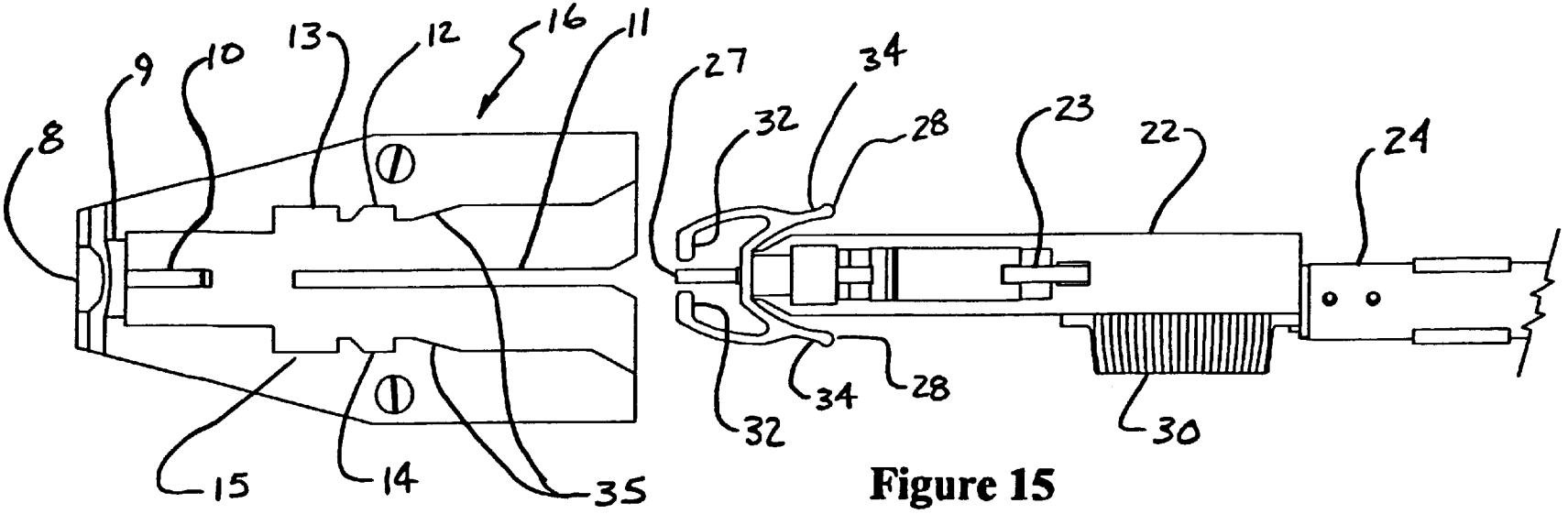
FIG. 15 shows a partial top view of the embodiment of FIG. 14 used to explain the operation of the invention.

Referring to FIGS. 15 to 19, the sequence of interactions at the docking platform 16 as the docking slide 22 is coupled to the recharge cartridge 1 are shown. FIG. 15 shows the docking slide 22 being aligned with the slot 11 of the docking platform 16 just prior to its attachment. Circular projections 28 extend downward from the handles 34 such that they interact with the ramps and detent grooves 12, 13, 14, and 15 that are shown on the docking platform 16.

Figure 16:
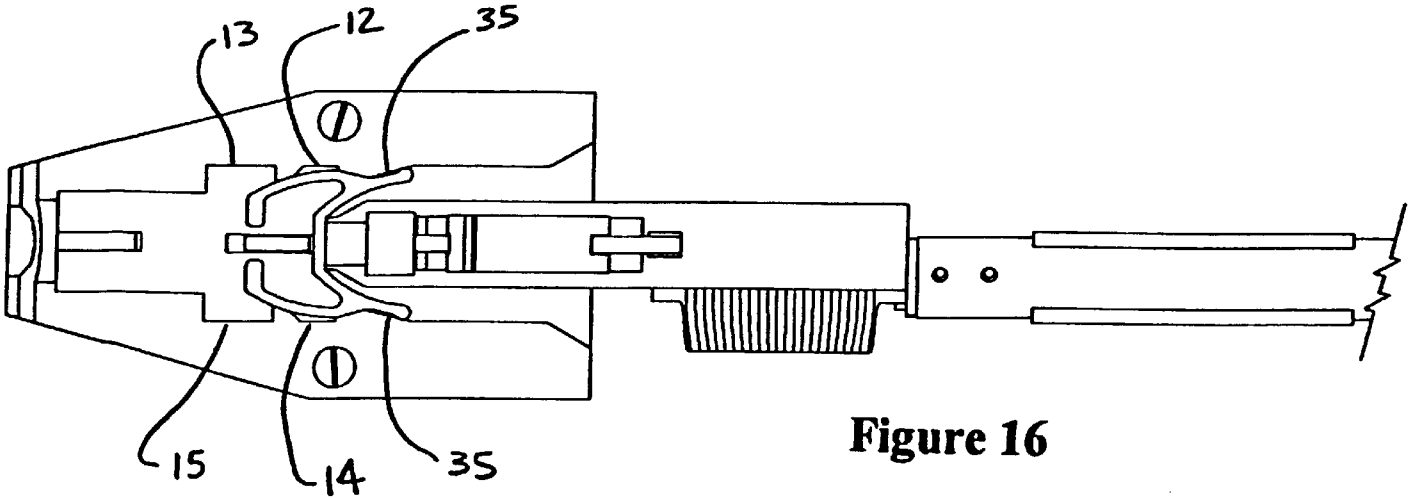
FIG. 16 shows a partial top view of the embodiment of FIG. 14 used to explain the operation of the invention.

FIG. 16 shows the docking slide 22 inserted into the docking platform 16 until the circular projections 28 have just made contact with the ramp surface 35. Further movement in the insertion direction causes the projections 28 to squeeze together and to then expand outward again as they pass over the ramp and move into the detent grooves A1 12 and A2 14.

Figure 17:
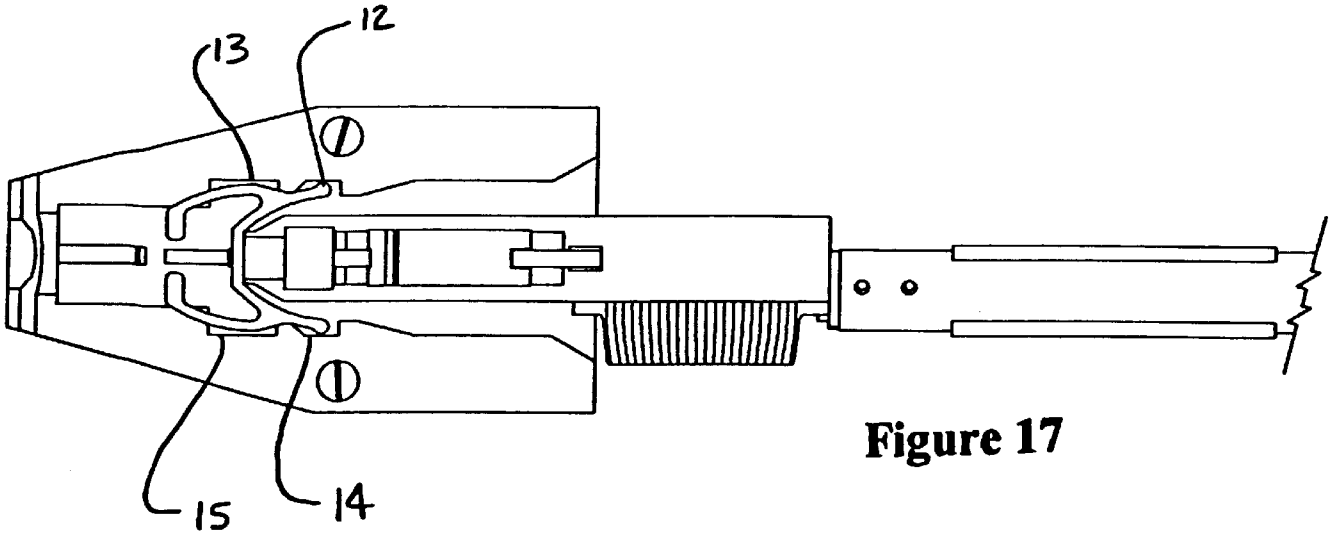
FIG. 17 shows a partial top view of the embodiment of FIG. 14 used to explain the operation of the invention.

FIG. 17 shows, at this position, the docking slide 22 is latched into the A detent position of the docking platform 16. This is a passively latched condition, as the docking slide 22 has some limited lateral freedom.

Figure 18:
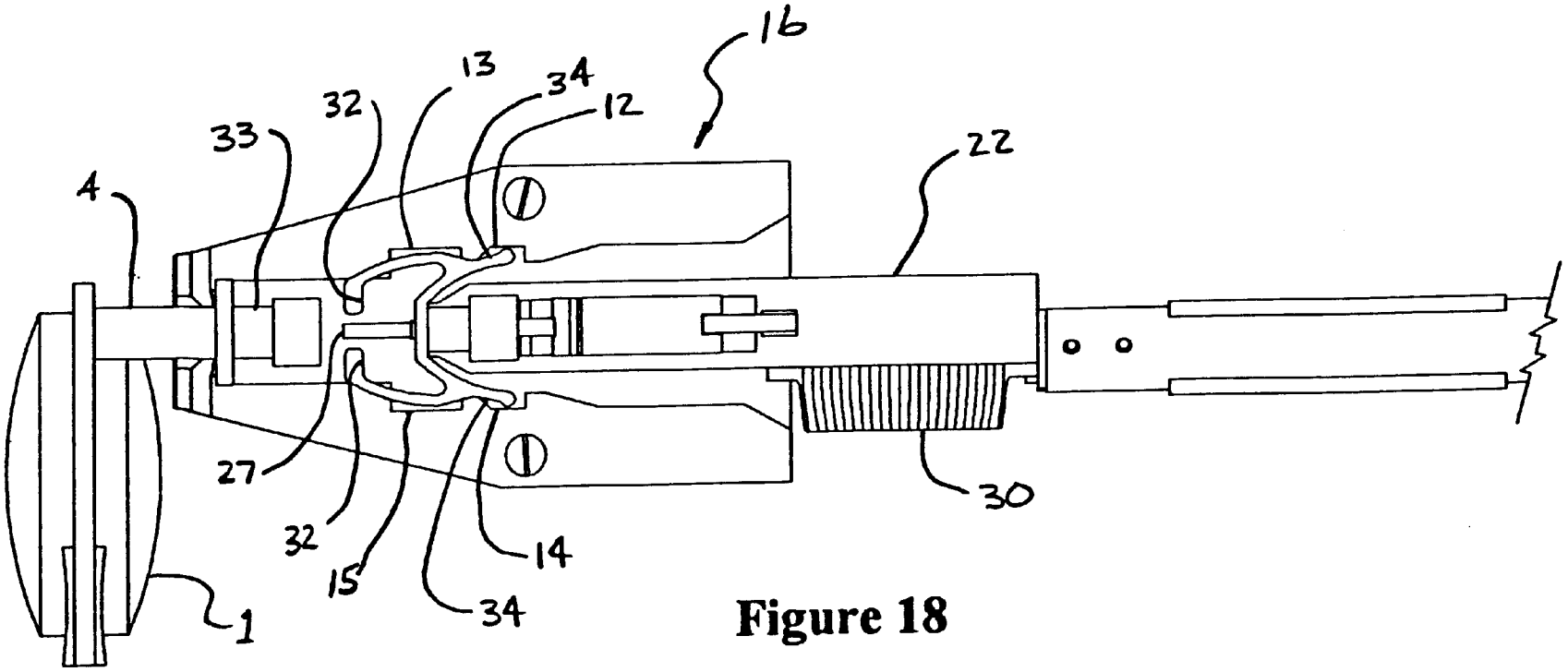
FIG. 18 shows a partial top view of the embodiment of FIG. 14 used to explain the operation of the invention.

FIG. 18 shows the docking platform 16 with the recharge cartridge 1 engaged in its seated position. The docking slide 22 is also attached to the docking platform 16 in its passively latched position as controlled by the A detent grooves 12 and 14. Note that the septum stem 4 is seated adjacent to the probe 27 of the docking slide 22, but is yet free to be vertically inserted or removed as long as the docking slide 22 coexists in its A detent aposition.

Figure 19:
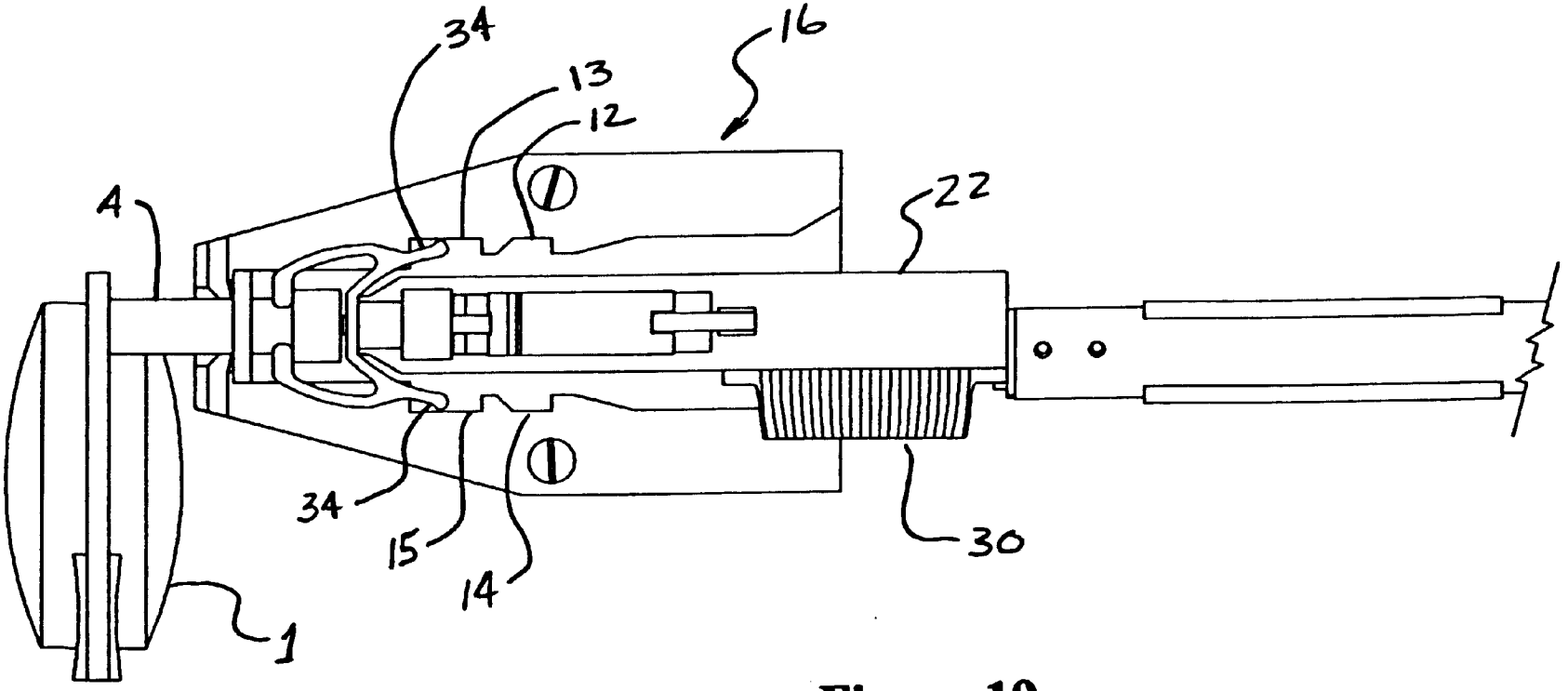
FIG. 19 shows a partial top view of the embodiment of FIG. 14 used to explain the operation of the invention.

In order to start the flow of ink from the recharge cartridge 1, the user grasps the handle 30 and pushes the docking slide 22 leftward in order to puncture the recharge cartridge septum 2 with the needle-like probe 27. The leftward slide motion collapses the handles 34 inward and simultaneously expands the docking hooks 32 outward, as the circular projections 28 pass by the ramp surface which forms the B detent groove. The hooks 32 expand over the periphery of the septum 2 as the needle-like probe 27 penetrates the septum 2, until the hooks 32 have engaged the retaining groove 33 in the septum stem 4 as shown in FIG. 19. The circular cam projections 28 then remain engaged in the B detent grooves of the docking platform 16. In this condition, ink flows from the recharge cartridge 1 to the smaller reservoir of the translating inkjet cartridge 21.

Figures 20, 20A:
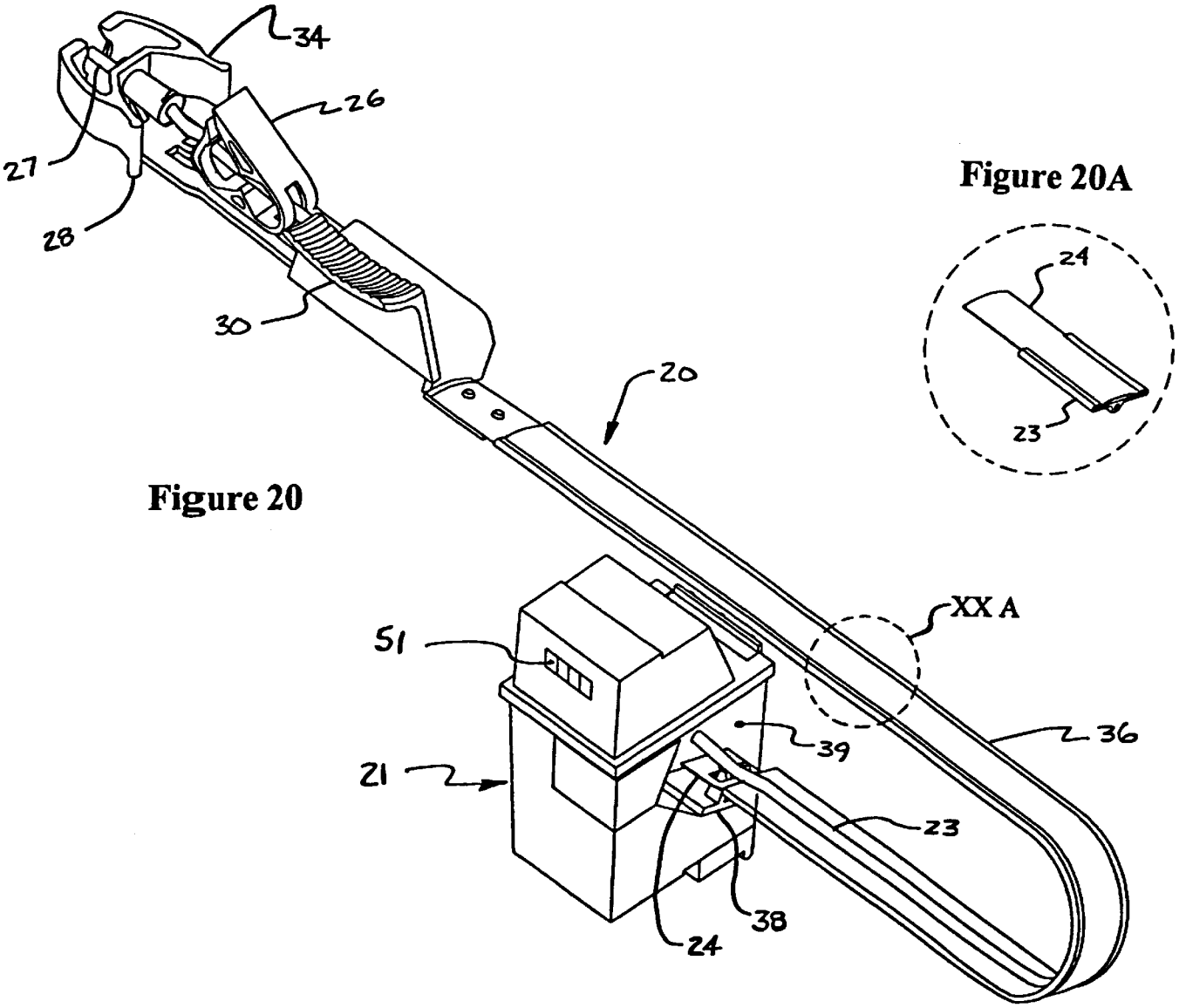
FIG. 20 shows a perspective view of a disposable host cartridge unit according to an embodiment of the invention.
Figure 21:
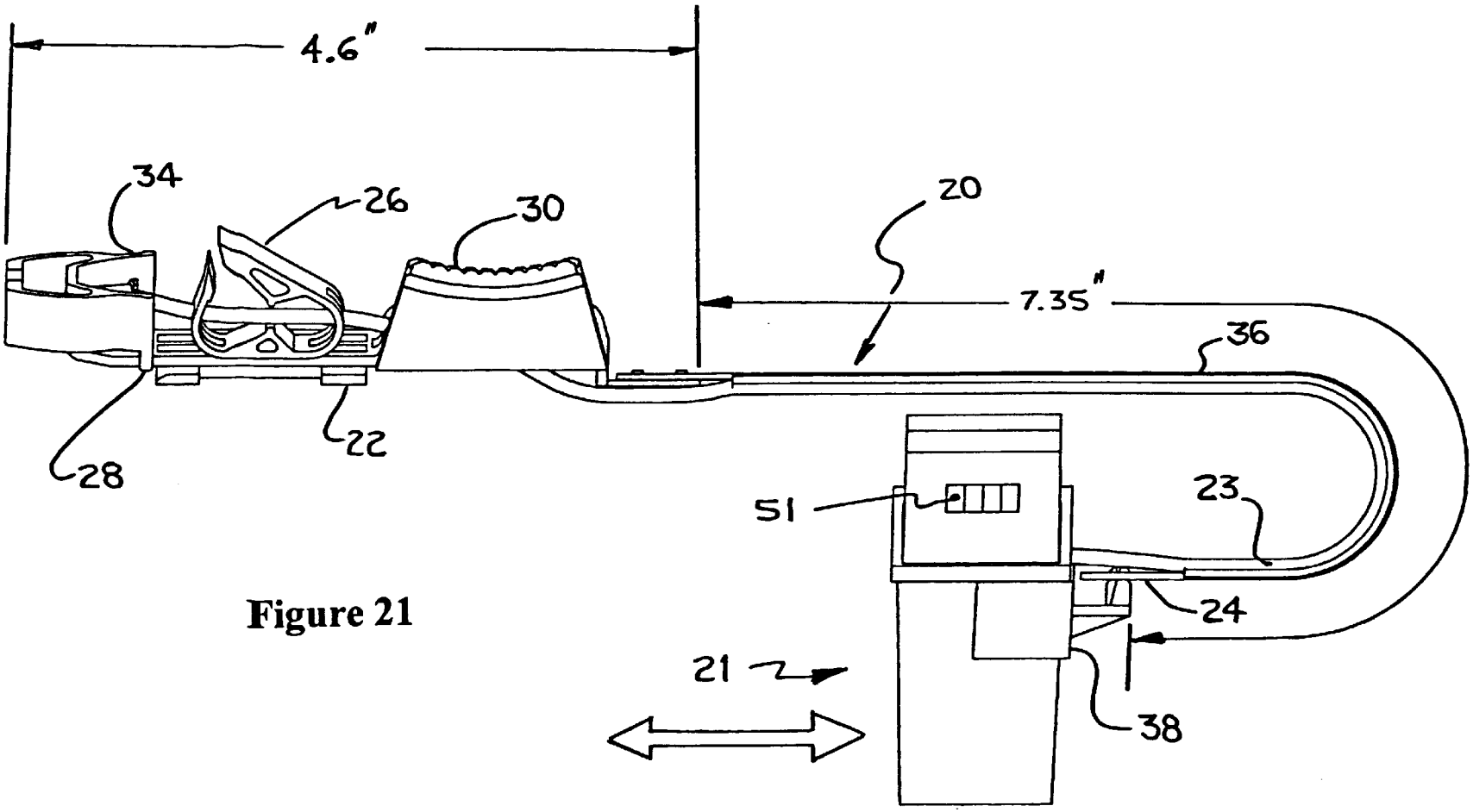
FIG. 21 shows an elevation view of the disposable host cartridge unit of FIG. 20.

Referring to FIGS. 20–21, disposable host cartridge unit 20 includes inkjet cartridge 21 with attached umbilical assembly 36. This unit includes a remanufactured inkjet cartridge 21 and an umbilical assembly 36 which contains a rigid portion and a flexible portion. The flexible portion is preferably 7.35" long and includes a flexible steel spine 24 and an elastomeric ink carrying conduit 23. The umbilical spine 24 is attached to the inkjet cartridge 21 by means of a bridle 38, extending outward from the inkjet cartridge to a region where a loop is formed in the spine 24. The loop preferably forms a 180 degree bend and extends leftward and above the inkjet cartridge 21 to a terminal end which is permanently attached to the rigid portion of the umbilical that comprises docking slide 22. An elastomeric ink carrying conduit 23 is attached to the steel spine 24 in such a way as to follow the exact movement and orientation of the spine 24. The docking slide 22 of the umbilical is preferably 4.60" in length and possesses means for interconnecting and clamping the ink carrying conduit 23 to the septum 2 of the recharge cartridge 1. This docking slide 22 also possesses various handles, latching surfaces and guide means which allow a user to attach and detach this end of the umbilical assembly 36 to a docking platform 16 as described above.

Figure 22:
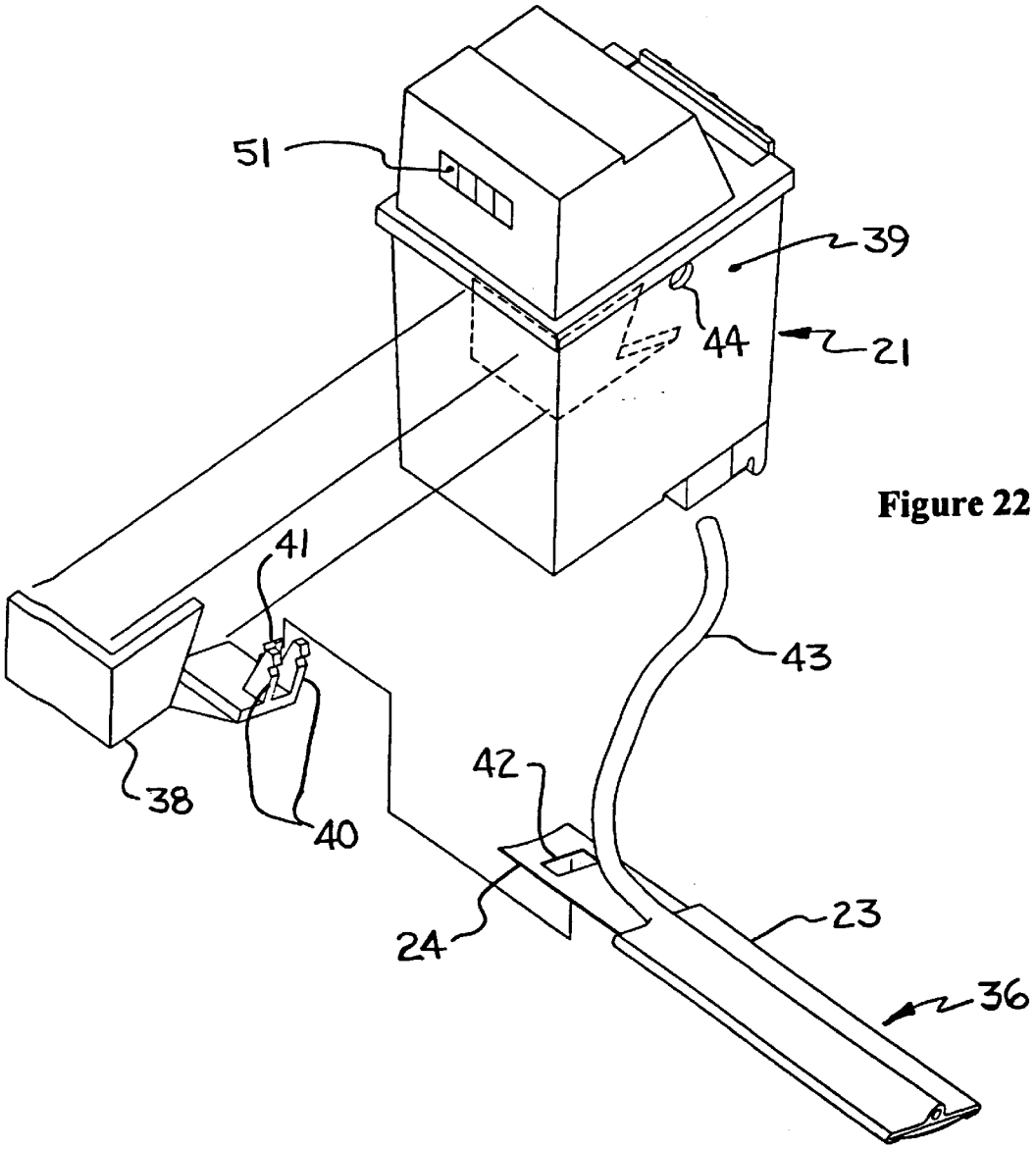
FIG. 22 shows a perspective view used in explaining the method used to interconnect the umbilical spine to the translating inkjet cartridge.

Referring to FIG. 22, the interconnection of the umbilical spine 24 to the translating inkjet cartridge 21 is explained. The particular inkjet cartridge depicted is an HP print cartridge, as originally manufactured by Hewlett Packard, which has been modified so as to attach the umbilical assembly 36. A hole has been added to the lateral surface 39 of the inkjet cartridge 21 to allow insertion of the ink conduit tube 23. An injection molded plastic bridle 38 is preferably adhesively attached to the corner of the inkjet cartridge 21 so as to provide attachment and alignment means for the flexible metal spine 24. Two cantilevered hooks 40 and a third flexible hook 41 are used to snap fit the bridle 38 into a rectangular hole 42 in the metal spine 24 such that the umbilical assembly 36 becomes a permanently attached extension of the inkjet cartridge 21. The terminal end of the elastomeric conduit 23 is trimmed to form a tubular extension 43 which is inserted into the cavity of the inkjet cartridge 21 through a hole 44 as shown. The tubing 43 is permanently sealed around the entrance hole 44 in order to prevent ink leakage.

Referring also to FIG. 21, the flexible steel spine 24 possesses a straight section along the axis of the inlket cartridge translation, forms a 180 degree loop and then returns along a second upper straight section which is parallel to the first. The spine 24 is preferably manufactured from thin steel strip which is 6 mils thick and 0.50" wide.

Referring to FIG. 23, the cross sectional shape of the spine 24 changes from radial as shown in FIG. 23A to a flat cross sectional shape in the loop portion of the spine 24 as shown in FIG. 23B. The cross section of spine 24 is radially shaped as shown in FIG. 23A, and preferably possesses a radius of 0.85". As the spine 24 transitions from its loop, and into the lower transverse region, it again assumes a radial cross section as shown in FIG. 23C. Note that for illustration purposes, FIG. 23 does not show the ink-carrying conduit 23 which is attached to the spine 24.

A unique attribute of the spine 24 is its ability to change shape as it rolls. The cross sectional shape changes itself from flat to radial as the loop moves laterally during the translational movement of inkjet cartridge 21. The change in cross sectional shape is self-induced by the motion of the loop, and is achieved by exploiting the so called "diaphragm effect", whereupon a body possessing a given shape reverts to an alternate shape if stressed beyond a certain limit. In this case, the bending stress induces the umbilical spine 24 to change from a radial shape to the ultimately flexible flat shape as it enters the traversing loop of the umbilical 36, and to change back to a radial shape as it exits the loop. One novelty of this invention stems from the fact that the moment of inertia of the umbilical spine 24 dynamically alters itself as it enters and exits the loop section during the traversing motion of the inkjet cartridge 21. The moments of inertia of the of the two sectional shapes are computed as follows:

Moment of Inertia for the Rectangular Section in the Loop

Figure 3:
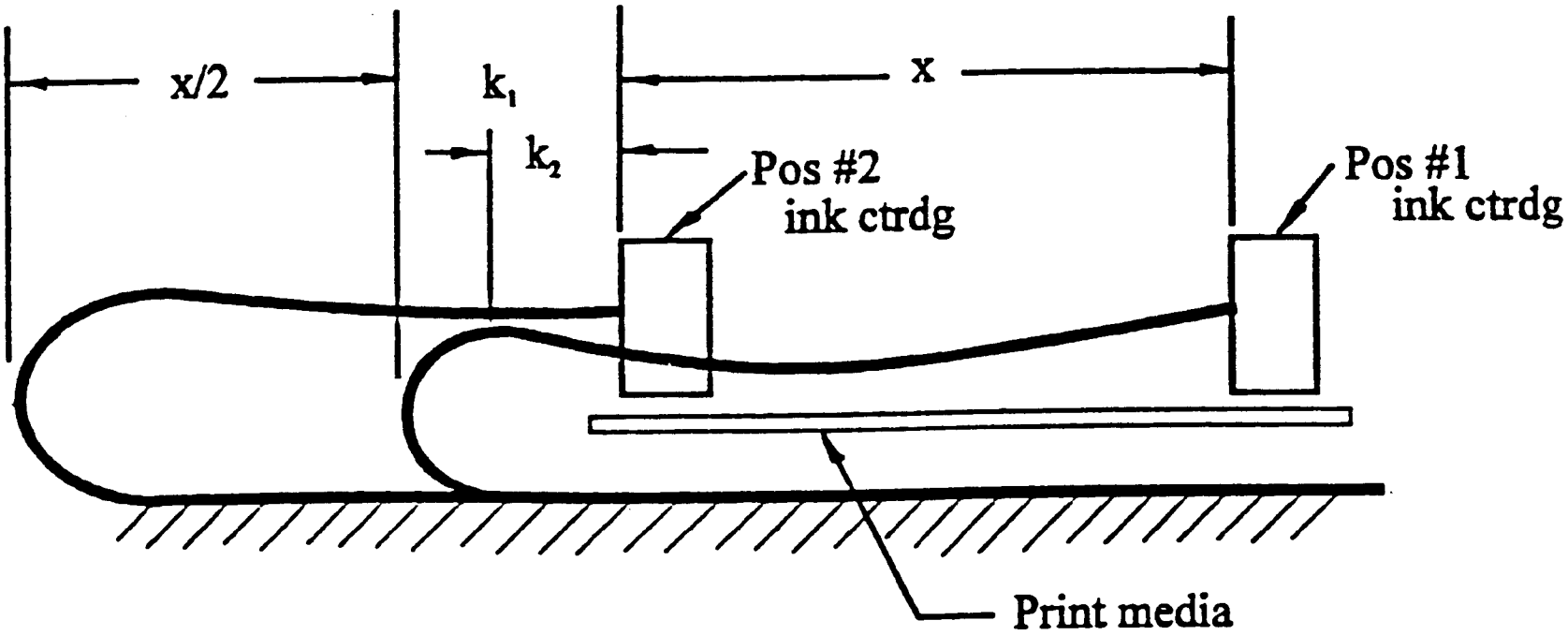
Figure 3 PRIOR ART
FIG. 3 shows a schematic diagram of a gravity oriented umbilical attached to a translating ink cartridge according to the prior art.
Figure 3A:
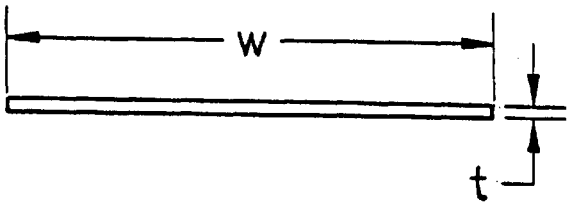
FIG. 3A shows a diagram used in explaining a moment of inertia for a thin rectangular section.
Figure 3B:
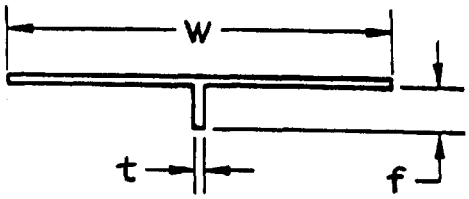
FIG. 3B shows a diagram used in explaining a moment of inertia for a "T" section.
Figure 3C:
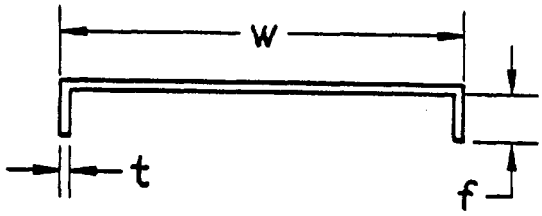
FIG. 3C shows a diagram used in explaining a moment of inertia for a channel section.
Figure 3D:
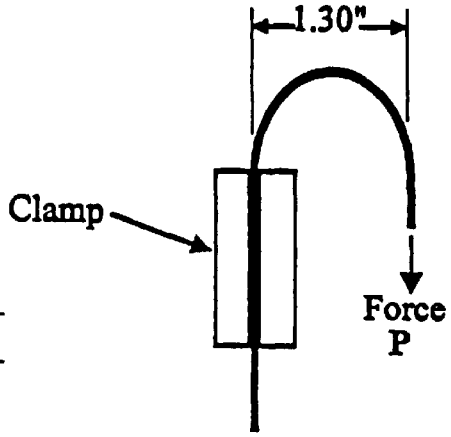
FIG. 3D shows a diagram used in explaining an analysis of bending forces.
Figure 3E:
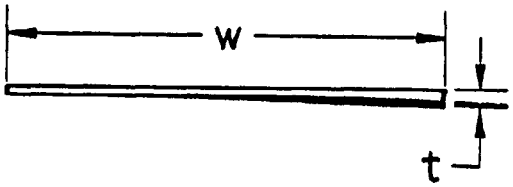
FIG. 3E shows a diagram used in explaining a moment of inertia for a rectangular section in a loop.

Referring to FIG. 3E, $I=wt^3/12$ where I=moment of inertia ($in^{4)}$

Therefore, $I=(0.50)(0.006)^3/12$ w=0.50=width of the spine (in)

and $I=0.009\times10^{-6}$ $in^4 \leftarrow$ t=0.006=thickness of the spine (in).

Alternatively, the moment of inertia of the spine 24 in the straight regions which possess the radially shaped cross section can be computed according to the equations below as explained by Roark and Young, "Formulas for Stress and Strain", 5th ed., McGraw-Hill, p.69.

Moment of Inertia for the Radially Shaped Cross Section

Figure 3F:
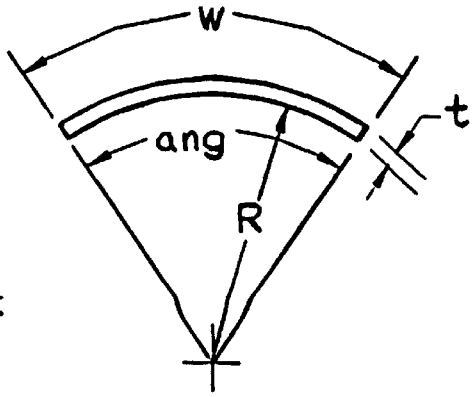
FIG. 3F shows a diagram used in explaining a moment of inertia for a radially shaped cross section.

Referring to FIG. 3F, $I=R^3t[z_1\ z_2+z_3\ z_4]$ where I=moment of inertia ($in^4$), t=0.006=thickness of the spine (in), and R=0.850=radius of curvature (in).

$\alpha$=0.291155=included angle (radians), $z_1=1-3t/2R+t^2/R^2-t^3/4R^3$ $z_2=\alpha+\sin\alpha\cos\alpha-2\sin^2\alpha/\alpha$ $z_3=1-t/R+t^2/6R^2$ $z_4=t^2\sin^2\alpha/3R^2\alpha(2-t/R)$.

Then substituting t=0.006, R=0.85, and $\alpha$=0.291155;

$$I=(0.85)^3(0.006)[(0.978873)(91\times10^{-6})+(0.992949)(2.4\times10^{-6})]$$

and therefore $I=0.34\times10^{-6}$ $in^4$.

Then summarizing:

| Sectional Shape | Moment of Inertia $in^4$ | Stiffness ratio |
|---|---|---|
| Flat rectangular | $0.009\times10^{-6}$ | 1.0 |
| Radially curved | $0.340\times10^{-6}$ | 37.7 |

It is understood from the earlier analysis that the flat sectional shape offers the least resistance to rolling into the loop. The flat sectional shape is thus the optimal shape for rolling. The analysis here shows that the spine 24 is significantly more stiffer in the regions where the radially shaped cross section exists by a factor of 37.7. Conversely, the region of the spine 24 that rolls is significantly more flexible than the straight regions by a factor of 37.7. This dual stiffness characteristic allows the spine 24 to be self-supporting and stable, while yet providing the minimal possible resistance to rolling. The radial shape in the non-looped regions stiffens these regions in a manner similar to that of the slats in venetian blinds. No catenary shape exists in these regions. As with the venetian blind slat, the radially shaped cross section maintains these regions in a straight orientation. The result is a self-supporting spine configuration in the shape of a "U" whose orientation and path of movement is entirely predictable. The overall "U" shape, as shown in FIG. 21, is stable in all planes, and will not collapse if oriented in any particular inclination to the axis of gravity. These properties allow the spine 24 to be self-supporting and to also possess a 180 degree loop which rolls with minimal possible resistance as the inkjet cartridge 21 translates.

Figure 24:
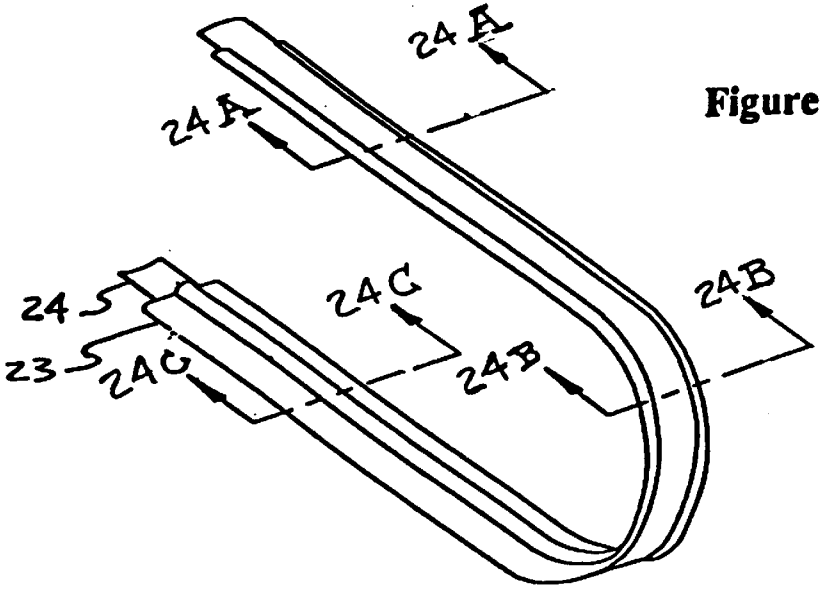
FIG. 24 shows a perspective view of an umbilical with an ink carrying conduit according to the present invention.

Referring to FIG. 24, the umbilical 36 with the ink carrying conduit 23 is shown attached to the flexible spine 24. A soft elastomeric material such as Tygon R-3603, is extruded into a custom shape as shown by the crosshatched region in FIG. 24A. A central section possesses a hollow tubular passage 45 that is utilized as the ink conduit. Flanged sections protrude laterally in both directions from the central tube, and these are terminated on the edges, by hooked sections 46 whose purpose is to grasp the periphery of the radially shaped spine 24. The flanged sections 46 are trimmed at each end of the a conduit 23 as shown in FIG. 25. The end portions 43 of the conduit 23 are thus made smaller so as to pass through the clamp valve 26 on the docking slide, and to enter the aperture 44 and into the reservoir of the inkjet cartridge 21 on the opposite end of the umbilical 36.

Figure 24C:
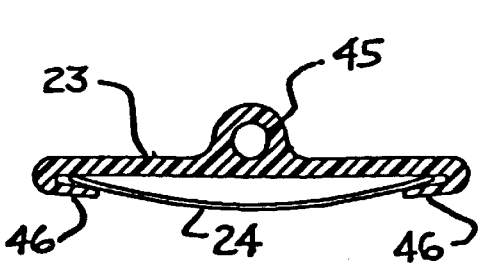
FIG. 24C shows a cross-section of the umbilical of FIG. 24 taken across line C—C.
Figure 24B:
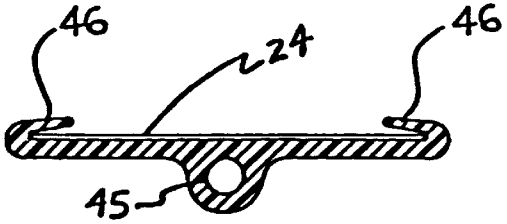
FIG. 24B shows a cross-section of the umbilical of FIG. 24 taken across the line B—B.
Figure 24A:
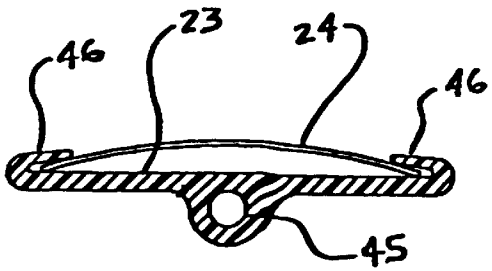
FIG. 24A shows a cross-section of the umbilical of FIG. 24 taken across the line A—A
Figure 25:
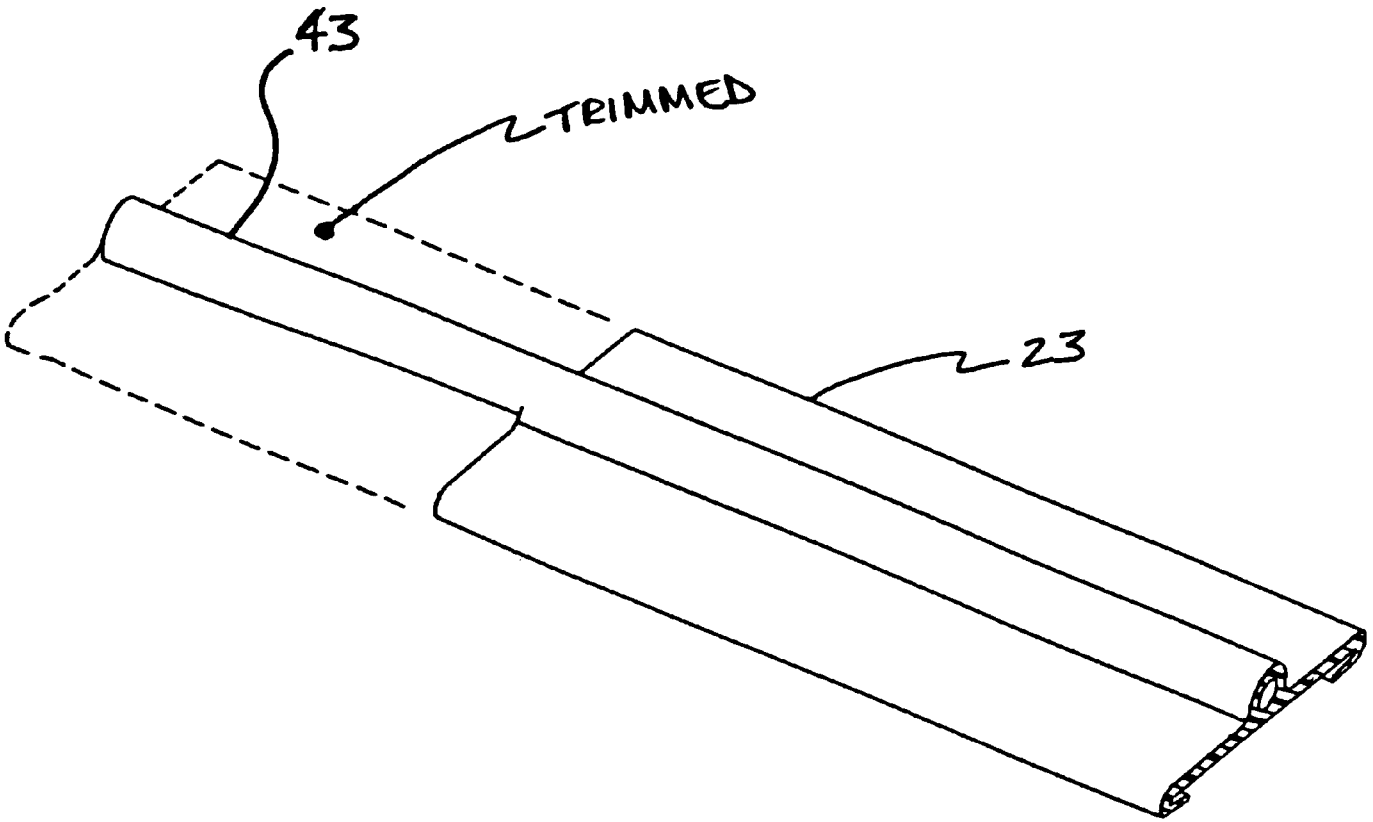
FIG. 25 shows a partial perspective view of the umbilical of FIG. 24.

FIGS. 24A and 24C show the shape of the umbilical in its non-looped regions, while FIG. 24B illustrates the shape in the looped region. The conduit 23 adheres to the shape and orientation of the flexible spine 24 as the spine rolls into and out of its loop. In this way the conduit 23 cannot become twisted, kinked or entangled during operation, and a uniform hydrodynamic pressure is maintained between the two reservoirs. An important attribute of this umbilical construction is the ease by which the host cartridge unit 20 is handled during its insertion or extraction from the desktop printer.

Figure 26:
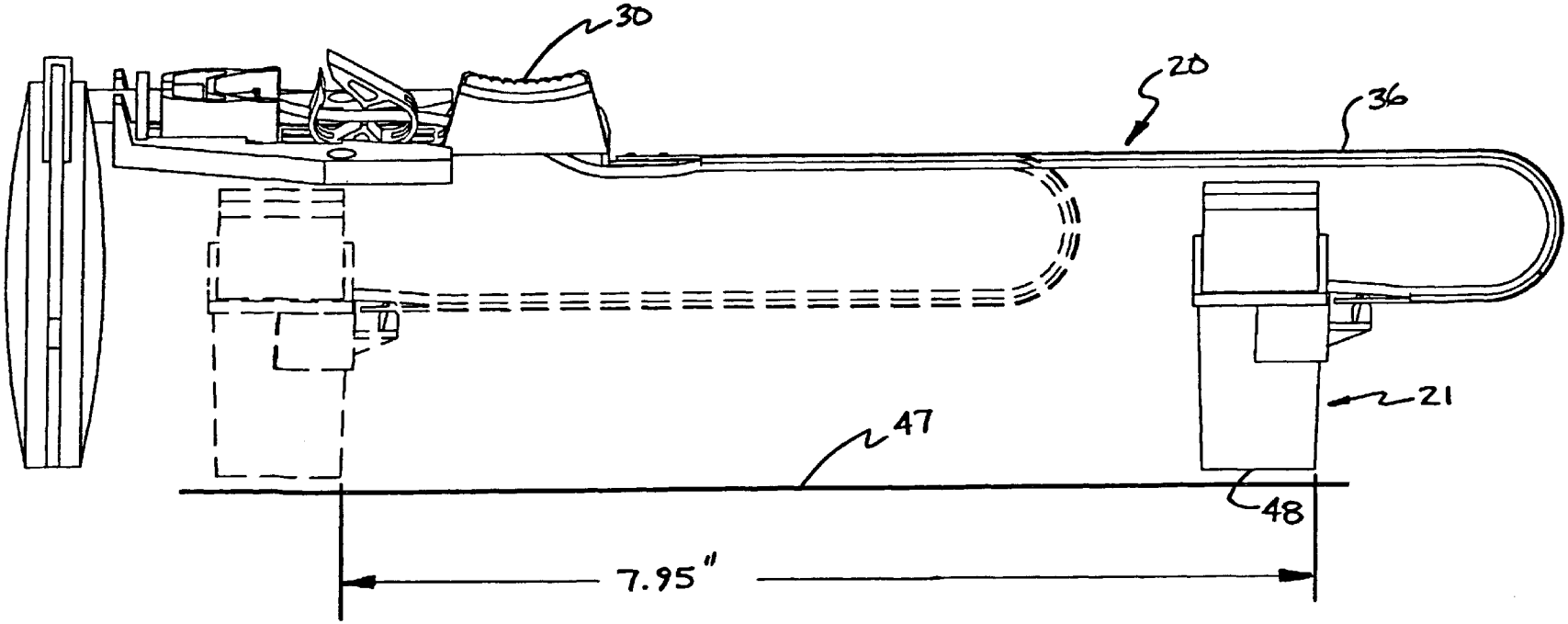
FIG. 26 shows a partial side view of an embodiment of the invention used in explaining the lateral range of motion of the inkjet cartridge.

Referring to FIG. 26, the lateral range of the inkjet cartridge 21 motion is now described. The solid outline represents the extreme right position of the inkjet cartridge 21 and umbilical 36, while the dashed periphery illustrates the maximum leftward position of the inkjet cartridge 21 and umbilical 36. The receptor of the printed ink droplet patterns is media 47 shown adjacent to the nozzle surface 48 of the inkjet cartridge 21. As the inkjet cartridge traverses from its leftward position to its rightward position, its nozzles are actuated in appropriate sequence by the printer controller, so as to produce a pattern of ink dots in the form of a stripe on the media. Upon completion of the stripe, the media 47 is incrementally advanced to a next vacant stripe region. The printer controller then translates the inkjet cartridge in the opposite direction, from right to left, as the next stripe is being in printed. This alternating stripe generation process persists until the entire page image is completed.

During the translational printing motion, the inkjet cartridge 21 traverses within a zone which is bounded by the media below and the umbilical above. The traversing loop of the umbilical 36 also translates within the same zone within the swept volume of the inkjet cartridge 21. In this way, the otherwise unutilized swept volume of the inkjet cartridge 21 can be exploited for use as the operational zone for the umbilical loop. The need for an external umbilical loop operating zone is thus avoided, and the printer configuration can be made compact.

The operation of the umbilical within the swept volume of the inkjet cartridge 21, is only feasible if the umbilical 36 is self-supporting and self-guiding. It is imperative that the umbilical be supported so as to avoid contact or dragging upon the printed media 47. If support devices were needed, these would obstruct the path of the translating inkjet cartridge 21. If guidance devices were needed, these would add rubbing friction that would manifest itself in additional transport motor loads. Instead, the unique umbilical spine configuration 36 is self-supporting and self-guiding, thus allowing the umbilical loop to traverse freely within the swept volume, while avoiding additional transport motor loading.

Figure 27:
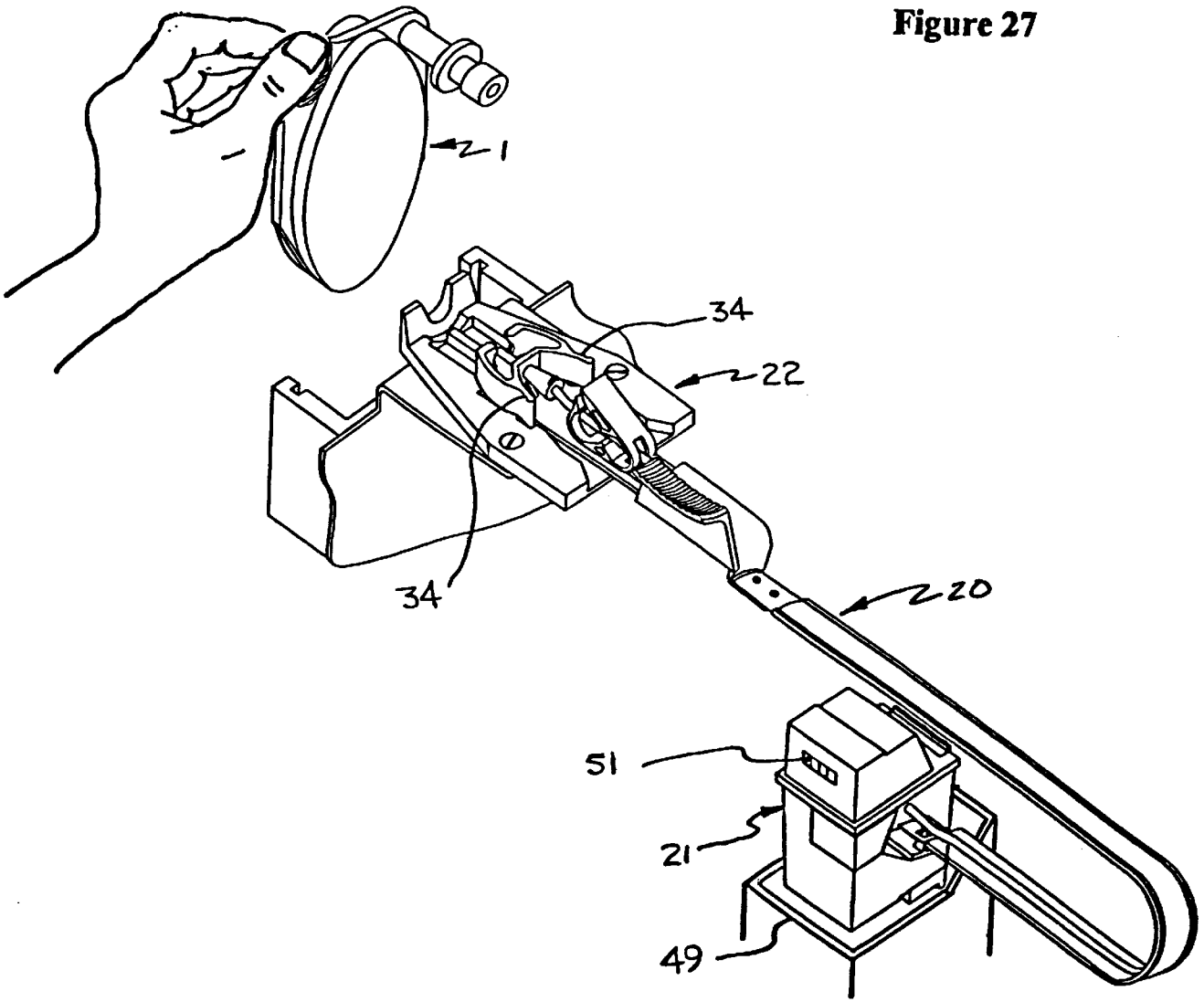
FIG. 27 shows a perspective view of the present invention used to illustrate replacing a recharge ink cartridge.

Referring to FIG. 27, the process of exchanging the recharge cartridge 1 simply requires that it be unlatched and then extracted from the printer. The user pinches the docking release handles 34 and moves the docking slide 22 laterally to the A detent recess position 12 and 14 FIG. 18). The lateral movement of the slide 22 extracts the docking probe 27 from the septum 2 due to the reaction force produced between the annular ring 3 on the septum stem 4 and the strain relief rib 10 on the docking platform 16. When the docking slide 22 becomes passively latched at the A detent recess 12 and 14, the recharge cartridge 1 is grasped at the finger pads 5 and vertically extracted from the printer chassis 17. A replacement recharge cartridge 1 may then be inserted and relatched to the docking slide 22. The recharge cartridge 1 is intended to be depleted and replaced 4 times during the service life of the host cartridge unit 20. An adhesive label 51 which is mounted to the inkjet cartridge 21 possesses 4 "boxes" which may be marked by the user when each new recharge cartridge 1 is inserted into the printer. In this way, the user may monitor the appropriate service life of the disposable host cartridge unit 20.

Replacement of the host cartridge unit 20 requires that the docking slide 22 be unlatched from the recharge cartridge 1. The user pushes the valve paddle 26 downward to close the valve before pinching the docking release handles 34 to move the slide 22 laterally beyond the A detent position and out of the docking platform slot 11. The inkjet cartridge 21 is extracted from its nest 49 by pulling the finger surface 50 to release its integral plastic latch. The depleted host cartridge unit 20 may then be removed from the printer and disposed.

The insertion of a fresh host cartridge unit 20 may be accomplished by grasping the insertion handle 30 of the docking slide 22. The user inserts the inkjet cartridge 21 into the translating cartridge nest 49 and pushes the upper surface 51 towards the rear of the printer until the cartridge 21 snaps into engagement with its integral plastic latch. The insertion handle 30 is grasped to bend the umbilical 36 over and insert the docking slide 22 into the engagement slot 11 of the docking platform 16. A continued lateral motion is used to move the slide 22 leftward until the septum 2 of the recharge cartridge 1 is punctured.

The printer may be operated without exploiting the economic advantages of the host cartridge unit 20. In this case, a conventional unmodified inkjet cartridge 21 may be utilized. The vacant docking platform 16 and absence of a recharge cartridge 1 impose no impediment to printer operation.

Figure 28A:
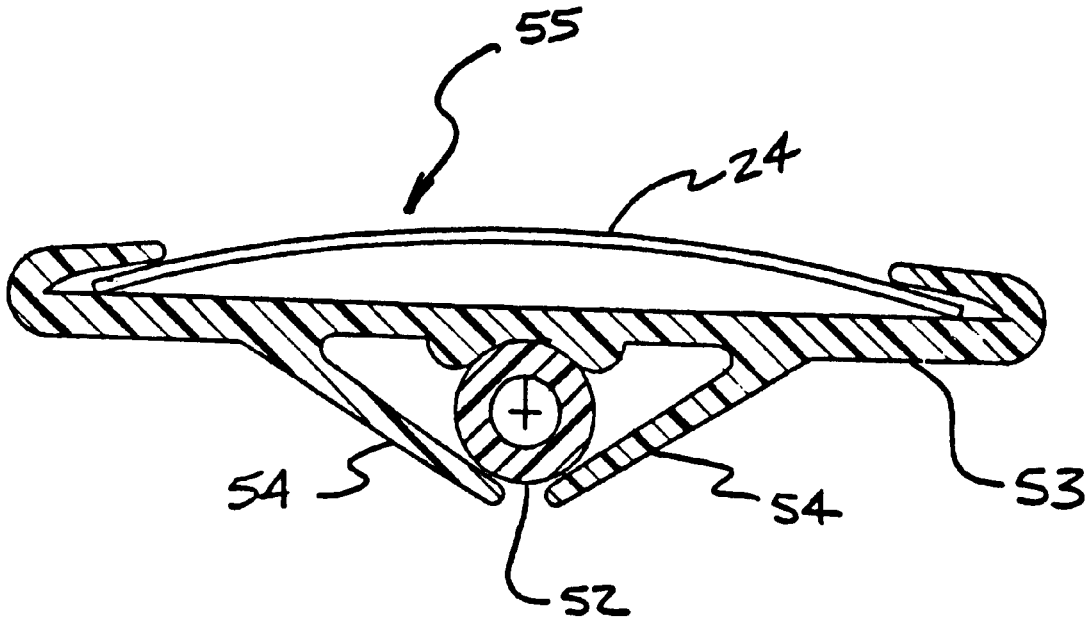
FIG. 28A shows a sectional view of an alternate means for attaching a tubular conduit to the flexible steel spine according to an embodiment of the present invention.

Referring to FIG. 28A, an alternate method for attaching a tubular conduit 52 to the flexible steel spine 24 to form an alternate umbilical assembly 55 is shown. In this alternate configuration, the tubular conduit 52 is cut from conventional tubing and attached via the clamping action of the flanges 54 of a custom elastomeric extrusion 53.

Figure 28B:
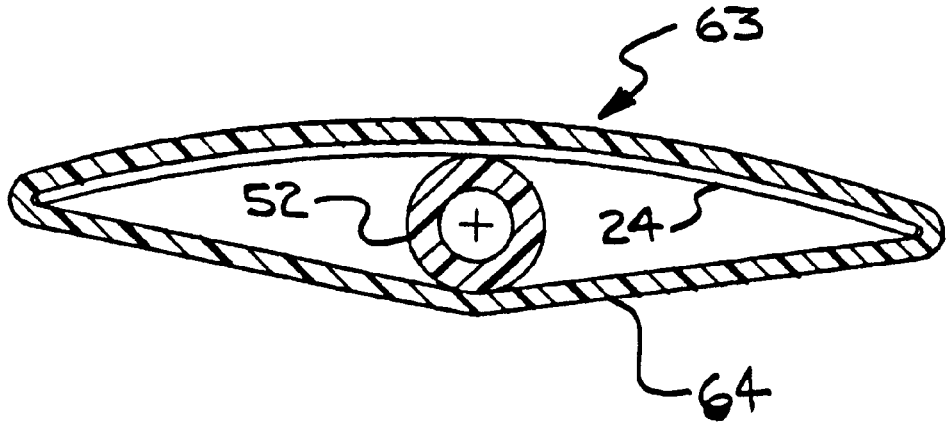
FIG. 28B shows a sectional view of another alternate means for attaching a tubular conduit to the flexible steel spine according to an embodiment of the present invention.

Referring to FIG. 28B, another alternate method for attaching tubular conduit 52 to flexible steel spine 24 to form an umbilical assembly 63. This configuration utilizes a thin flexible elastomeric sheath 64 to enclose fully conduit 52 and spine 24. Sheath 64 optionally encloses the umbilical along the entire length of spine 24, or optionally takes the form of narrow bands which are intermittently spaced along the longitudinal axis of the umbilical.

Figure 29:
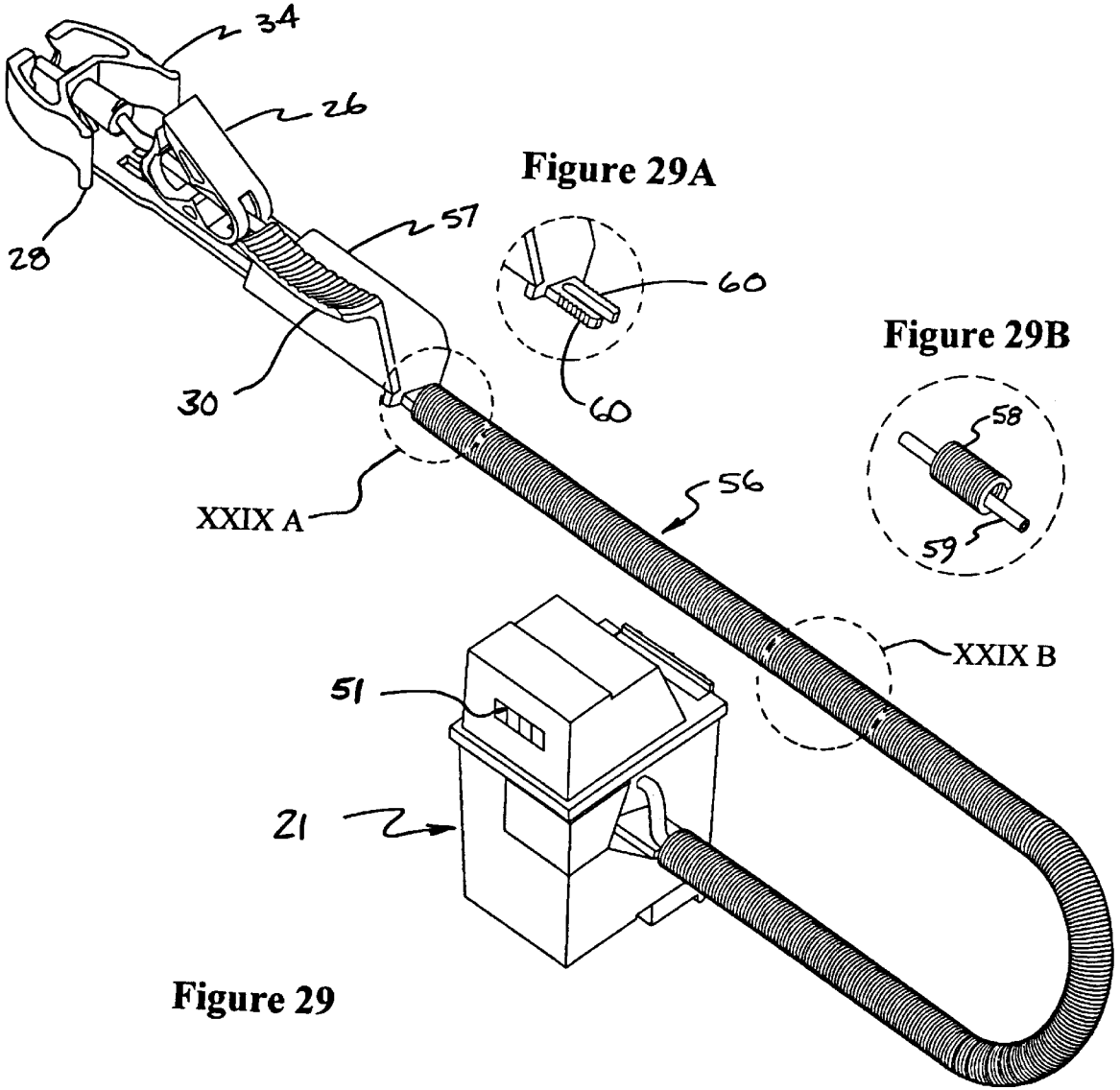
FIG. 29 shows a perspective view of a host cartridge unit according to an alternative embodiment of the invention.

Referring to FIG. 29, an alternate embodiment of the host cartridge unit 56 is shown. In this embodiment, the function of the umbilical spine is fulfilled by a helically wound wire tube 58 in the form of a tightly wound spring. The tubular ink conduit 59 is carried within the internal periphery of the helical spine 58, and is terminated at the docking slide 57 and at the inkjet cartridge 21 in the same manner as described in the preferred embodiment. The helical wire spine 58 is attached to the docking slide 57 by means of toothed projections 60, whose tooth pitch is slightly wider than the helical pitch of the wire spine 58. The helical wire spine 58 is compressed in the hoop direction in order to fit the internal periphery of the helix over the longitudinal axis of the teeth 60. The wire spine 58 then forms an elliptical sectional shape after removing the compressive force such that the helical wires permanently grip the toothed periphery 60 of the slider 57.

Figure 30:
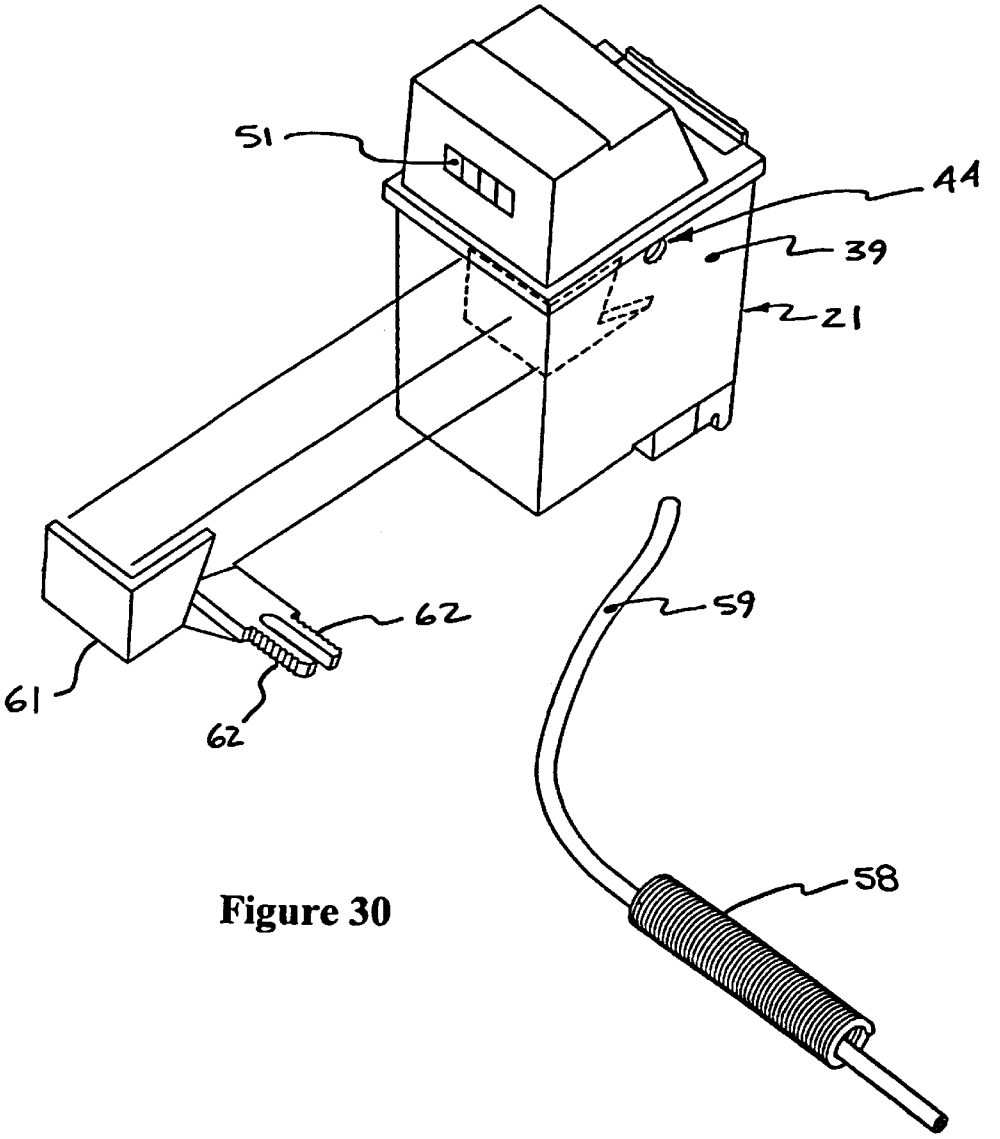
FIG. 30 shows a perspective view of the embodiment of FIG. 29 used to illustrate a method of assembling a helical wire spine to a translating ink cartridge.

Referring to FIG. 30, the method of assembling the helical wire spine 58 to the translating ink cartridge 21 is described. A hole 44 is added to the inlket cartridge 21 to allow insertion of the ink conduit tube 59. The tubing 59 is inserted into the reservoir of inkjet cartridge 21 and permanently sealed around the entrance hole 44 in order to prevent ink leakage. An injection molded plastic bridle 61 is adhesively attached to the comer of the inkjet cartridge 21 so as to provide attachment and alignment means for the helical wire spine 58. The spine 58 is attached to the bridle 61 by means of toothed projections 62, whose tooth pitch is slightly wider than the helical pitch of the wire spine 58. The helical wire spine 58 is compressed in the hoop direction in order to fit the internal periphery of the helix over the longitudinal axis of the teeth 62. The wire spine 58 then forms an elliptical sectional shape after removing the compressive force, such that the helical wires permanently grip the toothed periphery 62 of the bridle 61. The spine 58 and the tubular conduit 59 thus become a permanently attached umbilical extension of the inkjet cartridge 21.

Figure 1:
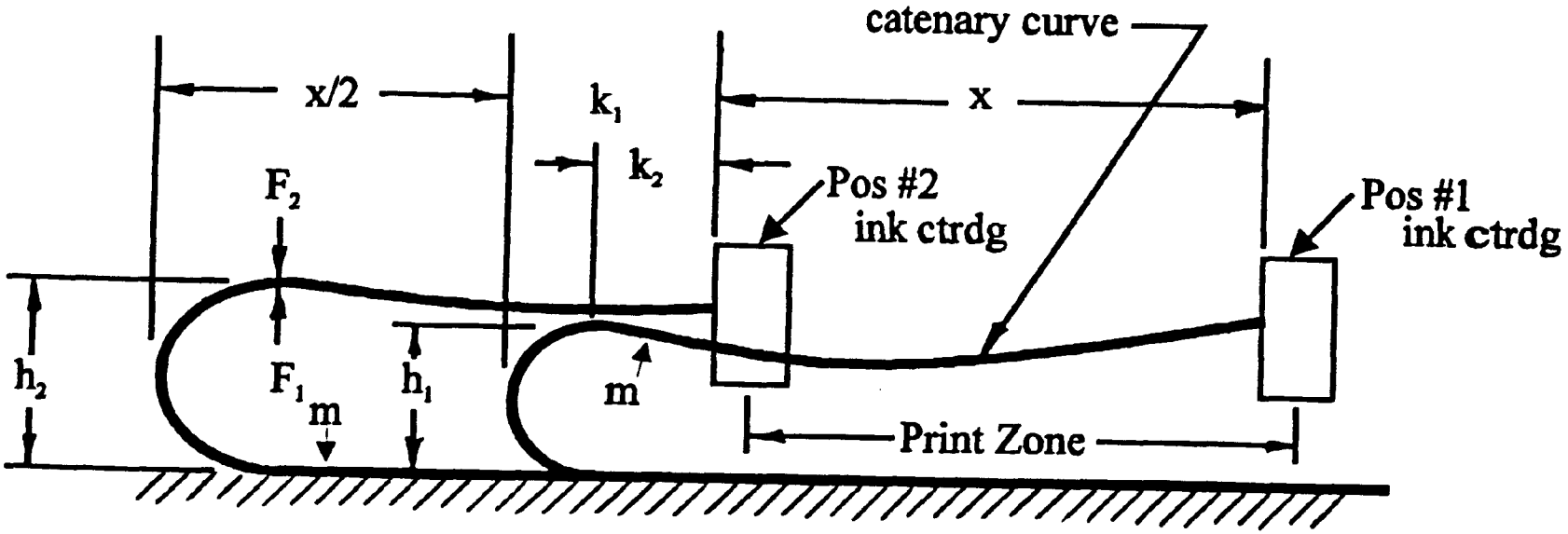
FIG. 1 shows a gravity oriented umbilical attached to a translating ink cartridge according to the prior art.
Figure 2:
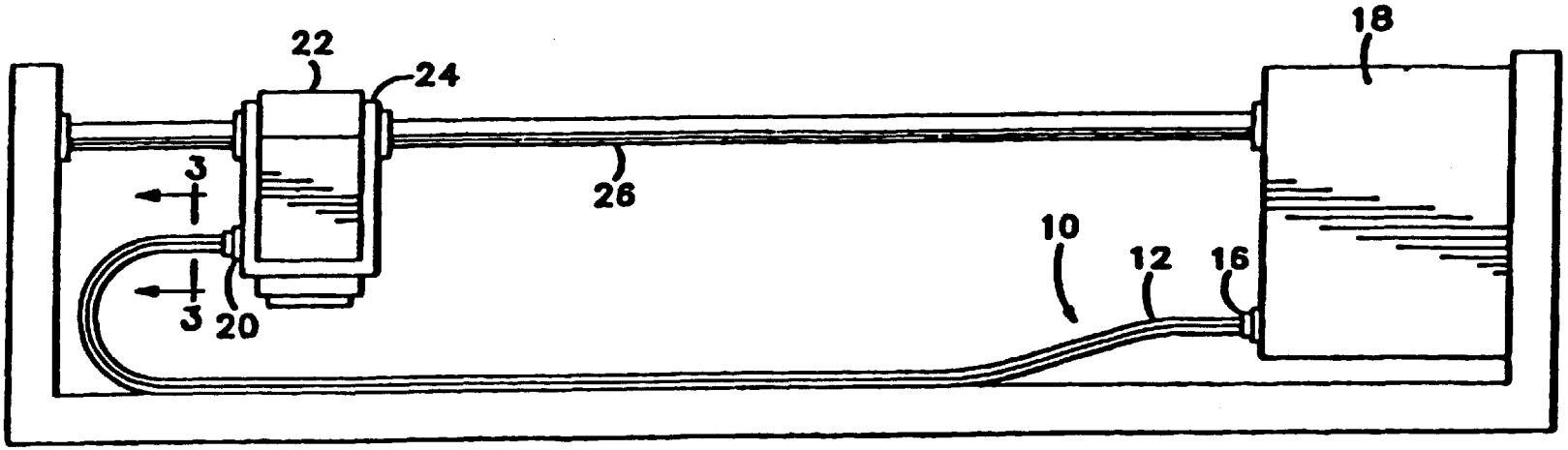
Figure 2 PRIOR ART
FIG. 2 shows a front elevation view of an umbilical attached to a translating ink cartridge and supported by a stationary frame member according to the prior art.
Figure 4:
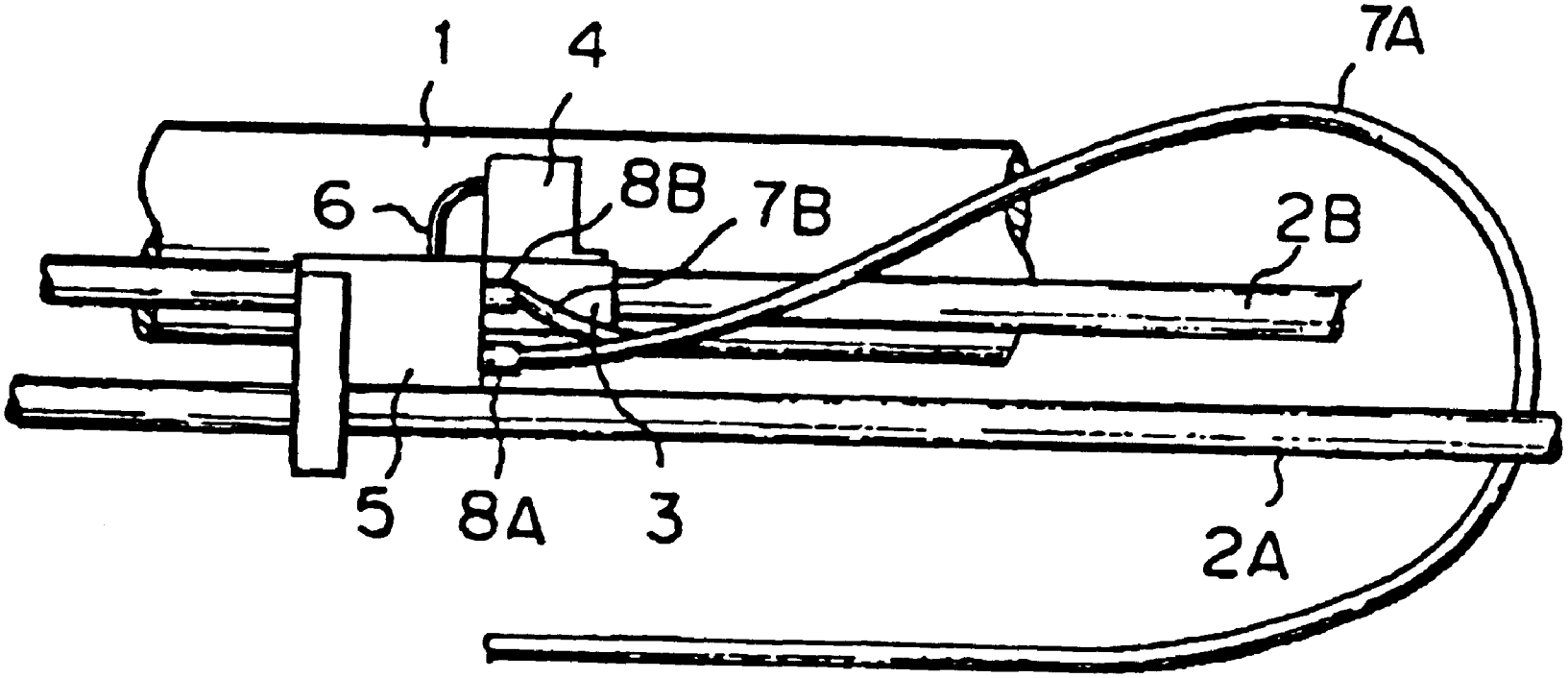
Figure 4 PRIOR ART
FIG. 4 shows a front elevation view of an umbilical according to the prior art.
Figure 5:
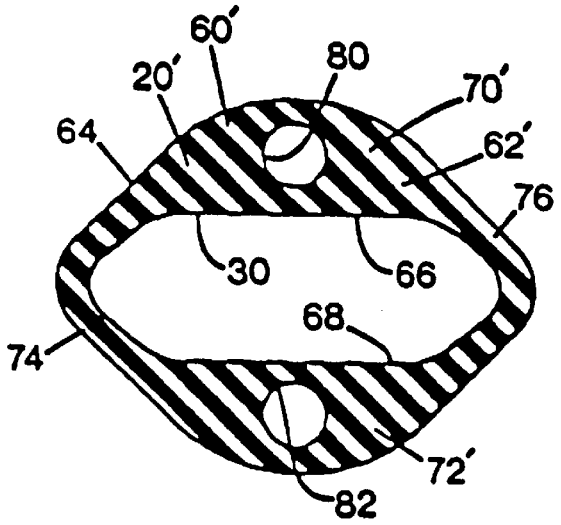
Figure 5 PRIOR ART
FIG. 5 shows a sectional view of a flexible ink carrying conduit according to the prior art.
Figure 6:
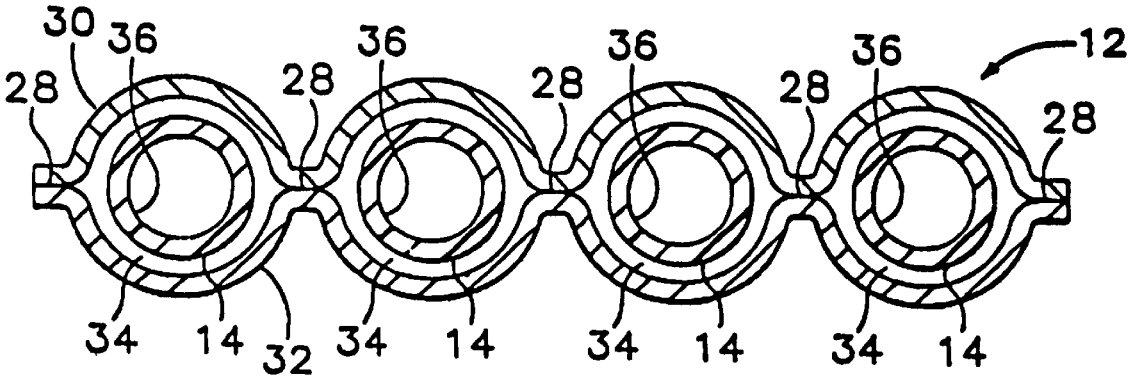
Figure 6 PRIOR ART
FIG. 6 shows a sectional view of a thin membrane material bonded over the periphery of several circular ink supply tubes according to the prior art.
Figure 7:
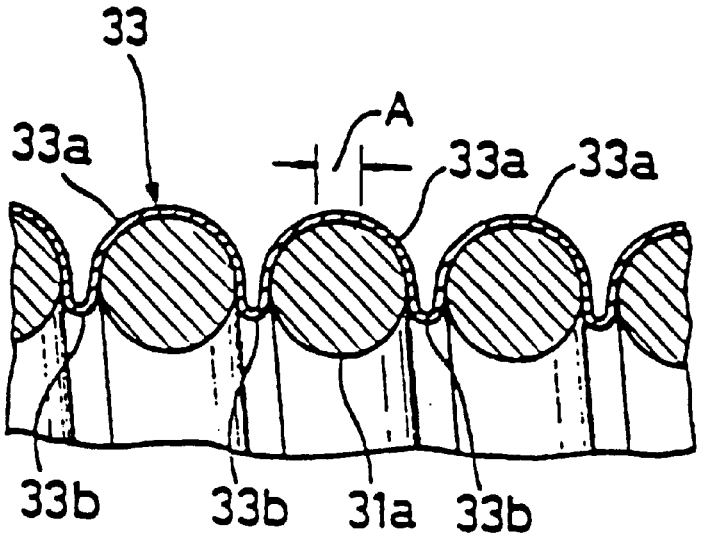
Figure 7 PRIOR ART
FIG. 7 shows a sectional view of a helically wrapped spring that provides a controlled flexible motion according to the prior art.
Figure 8:
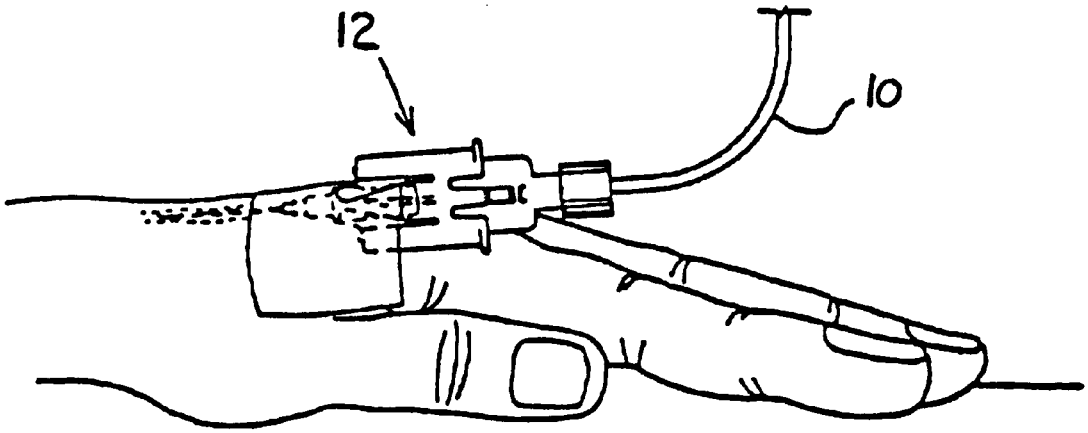
Figure 8 PRIOR ART
FIG. 8 shows a side view of sliding collar used to clamp a needle probe to a septum according to the prior art.
Figure 9:
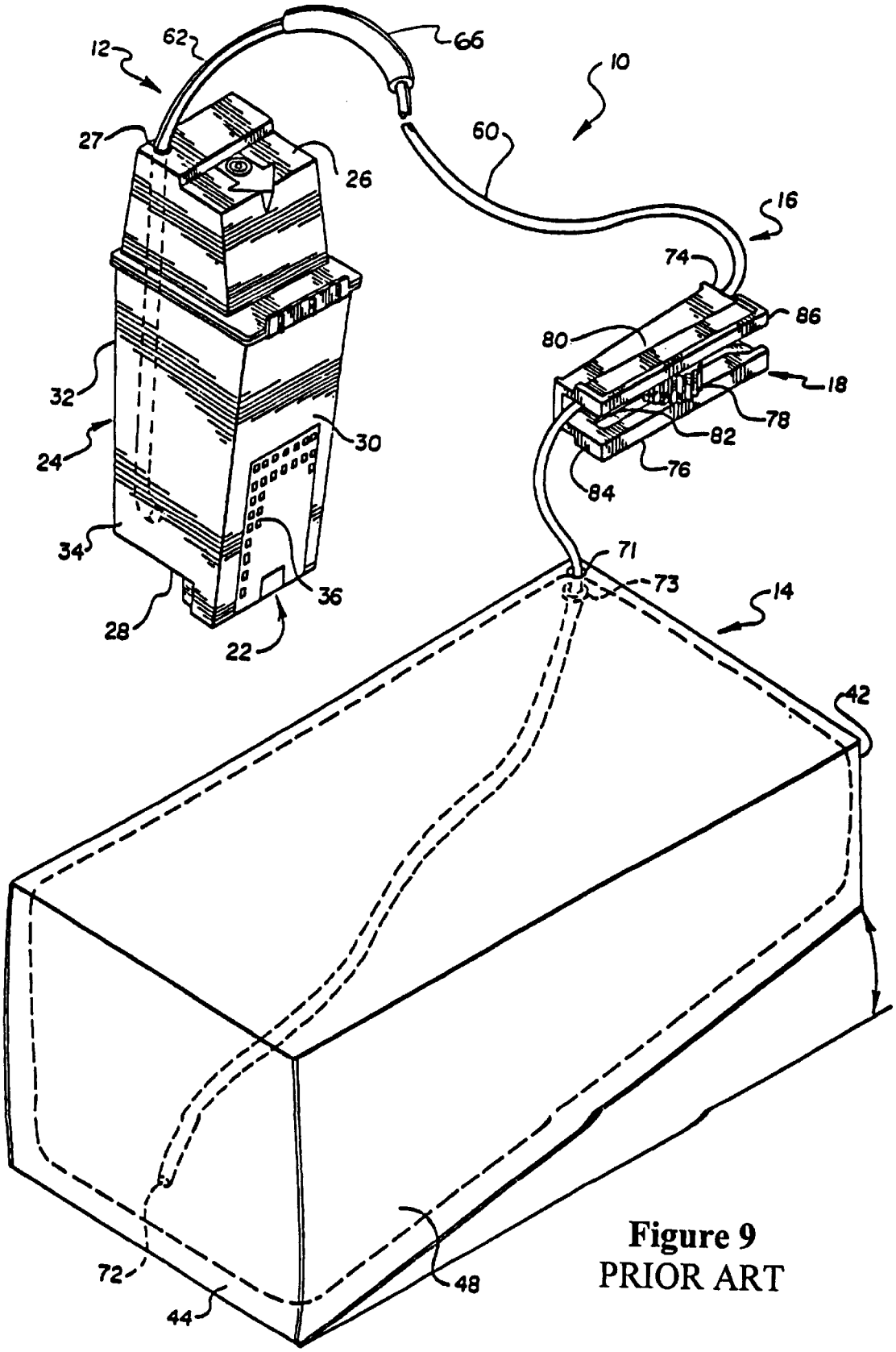
Figure 9 PRIOR ART
FIG. 9 shows a perspective view of a reservoir and ink cartridge according to the prior art.
Figure 10:
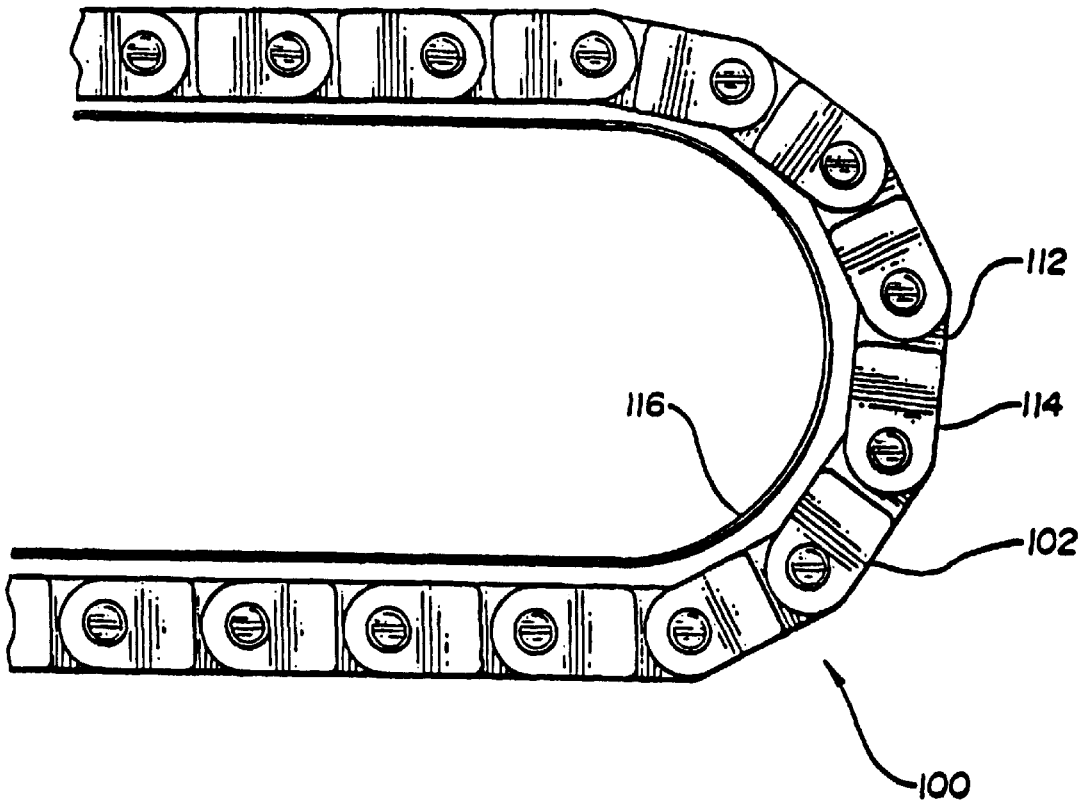
Figure 10 PRIOR ART
FIG. 10 shows a side view of plastic link chain used as a flexible umbilical carrier according to the prior art.
Figure 11:
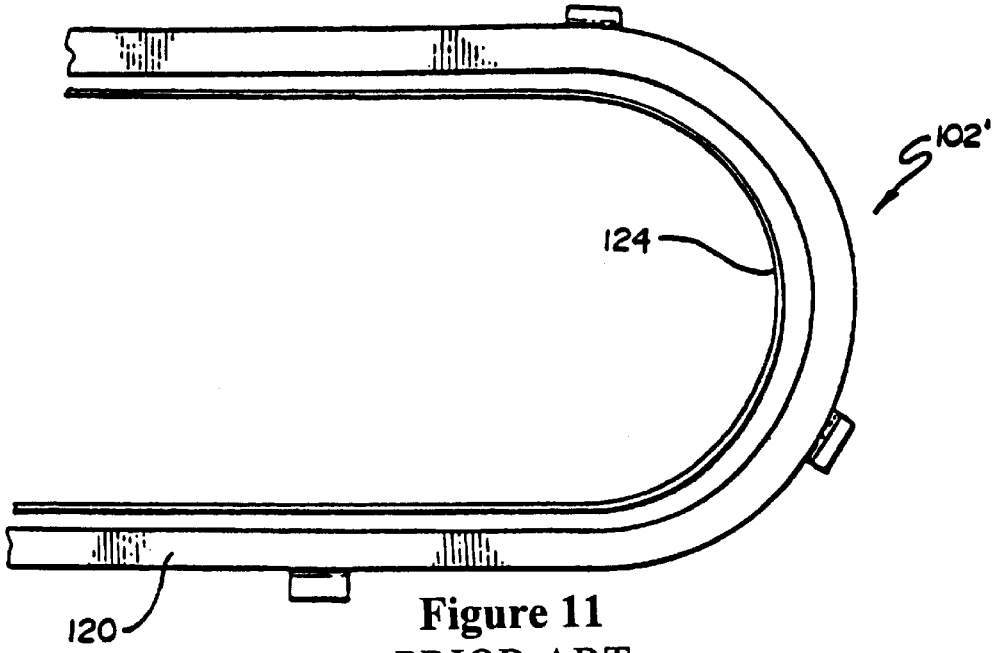
Figure 11 PRIOR ART
FIG. 11 shows a side view of channel and ink tubes according to the prior art.
Figure 12:
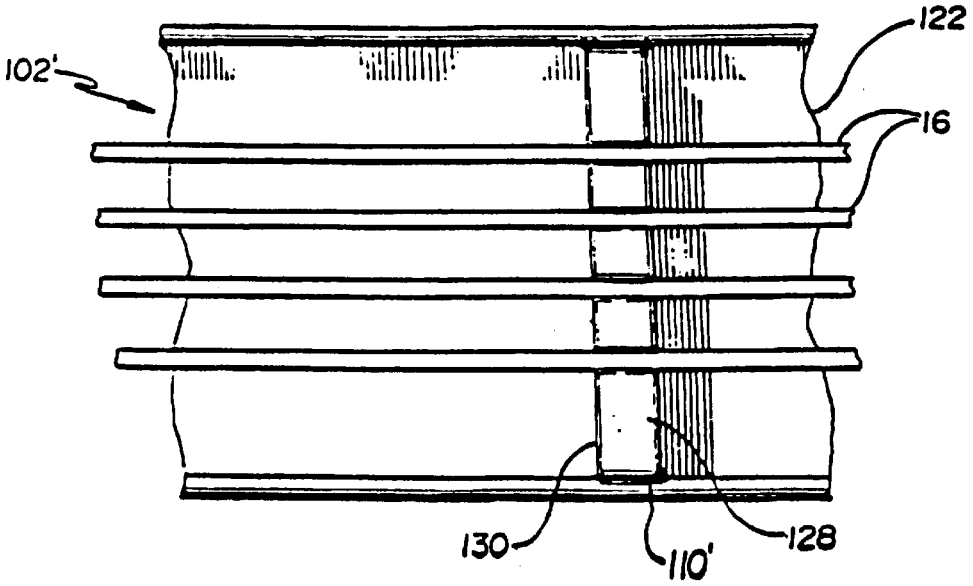
Figure 12 PRIOR ART
FIG. 12 shows a top view of the prior art of FIG. 11.
Figure 13:
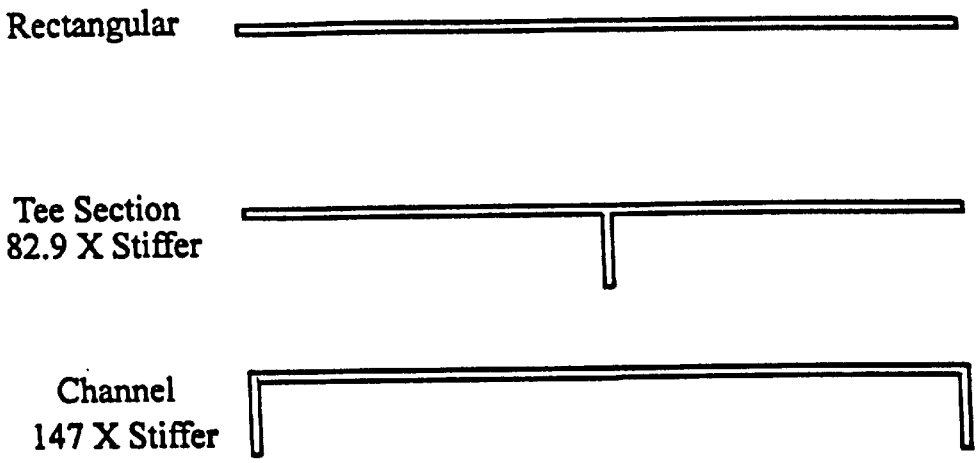
Figure 13 PRIOR ART
FIG. 13 shows a stiffness comparison of strip sectional shapes as known in the art.
Figure 13:
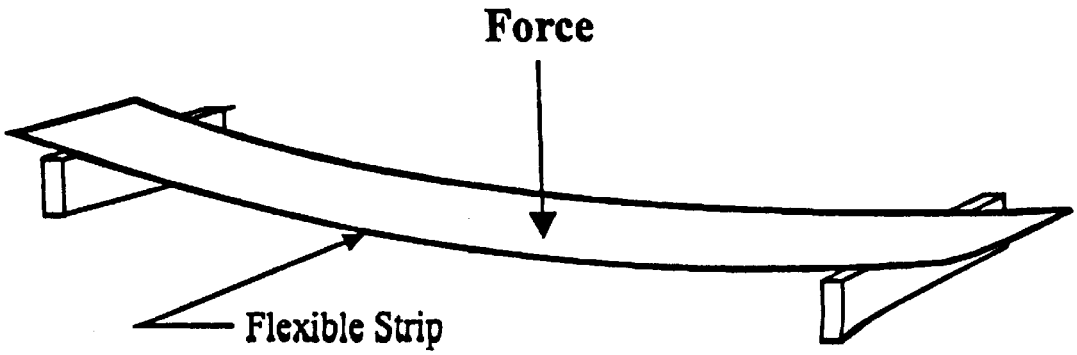
Figure 13 PRIOR ART

A common element of the umbilical configurations shown by the prior art is the support of the lower umbilical section by an element of the machine structure such as is shown by FIGS. 2, 3, and 4. Control of at least a portion of the umbilical can be maintained when supported in this manner. However, this configuration mandates the need for a large operational area for the loop of the umbilical, as explained above.

Figure 31:
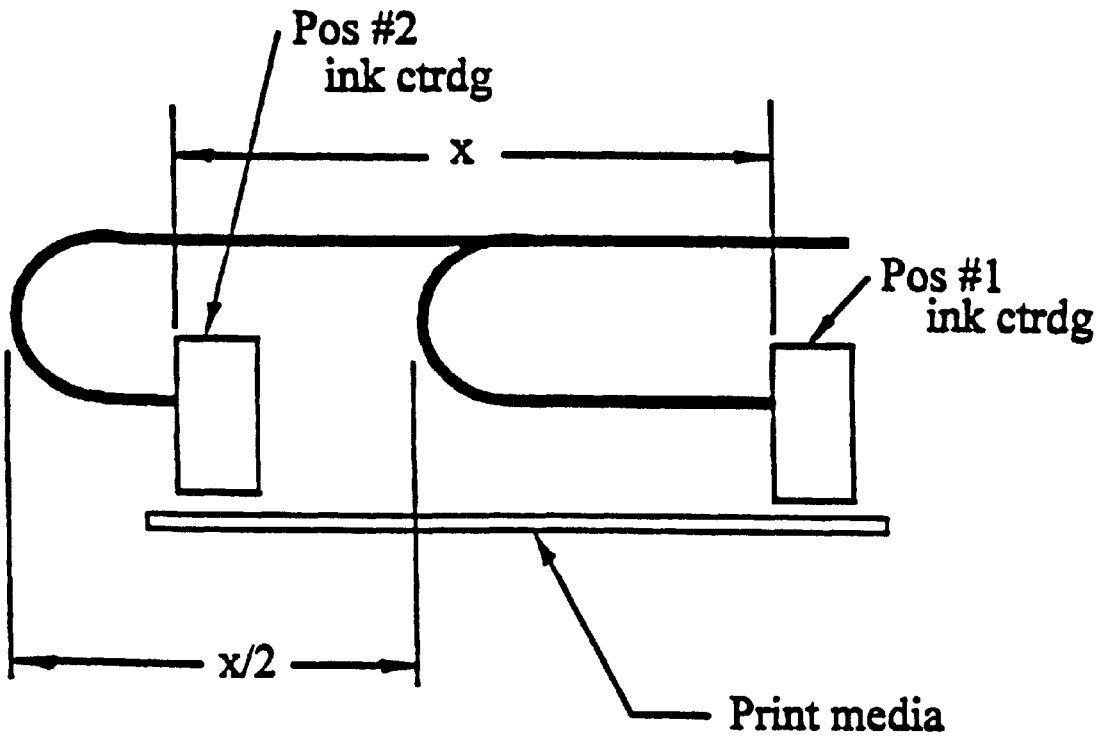
FIG. 31 shows an umbilical supported from above the media and inkjet cartridge path according to the present invention.

This region is eliminated if the umbilical is supported from above the media and inkjet cartridge path as shown in FIG. 31. In this orientation, the loop of the umbilical operates within the swept volume of the translating inkjet cartridge, and thus achieves better spatial efficiency. The means for achieving such an umbilical suspension requires that the lower transverse section not sag enough to touch the printed media surface, and that the upper transverse section of the umbilical not sag to the extent that it interferes with the translational path of the inkjet cartridge. These goals are fulfilled by an umbilical suspension that is self supporting to the extent that no external machine elements are needed for its support in a manner similar to the mythical "magic rope". One important benefit of such an umbilical suspension is the significant reduction of printer chassis size (footprint), as can be appreciated from a direct comparison between FIG. 3 and FIG. 31. The spatially efficient configuration of FIG. 31 is achieved by the invention explained herein.

The invention herein provides a docking station rather than a coupling, with a distinction being that the docking station provides means to control the orientation of the conduit in both the coupled and uncoupled states. This new invention provides a first state where the umbilical is locked to the septum of the stationary reservoir and a second state consisting of a passively latched retracted position whereupon the septum can be unlocked from the umbilical, and yet not disturb the attitude of, or lose control of the umbilical itself A third state allows the umbilical assemblage to be completely disconnected from the docking station in the case where the traversing ink cartridge must be exchanged. The docking station of the invention herein also makes provision to isolate the puncturing forces from the-septum conduit such that the axial stress of the puncturing operation is not experienced by the septum conduit. This important feature is not provided by the prior art.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A disposable ink refill system for an inkjet printer, comprising:

a) a recharge cartridge connectable to a chassis of said inkjet printer;

b) a host cartridge unit, which includes i) a translating inkjet cartridge, ii) a docking slide, and iii) an umbilical assembly having a first end having a longitudinally extending axis, a second end having a longitudinally extending axis, and an intermediate portion extending between said first end and said second end, said umbilical assembly being connected between said translating inkjet cartridge and said docking slide and connectable to said recharge cartridge at said first end, and wherein said intermediate portion remains substantially between said longitudinally extending axes during translational movement of said translating inkjet cartridge, said umbilical assembly further including an elastomeric ink carrying conduit and a flexible steel spine attached to said conduit, said spine having first, second, and third segments, said first segment being between an end of said umbilical assembly connected to said docking slide and a loop of said spine, said third segment being connected between an end of said umbilical assembly connected to said translating inkjet and said loop of said spine, said second segment being connected between said first segment and said third segment, said spine in said first segment having a downward-opening radial cross-sectional shape, said spine in said second segment having a flat cross-sectional shape, and said spine in said third segment having an upward opening radial cross-sectional shape; and c) a docking platform interconnectable with said docking slide.

2. A system according to claim 1, wherein said recharge cartridge includes:

at least one flanged surface fittable into a corresponding groove in said printer chassis;

a septum stem by which said recharge cartridge is connected to said first end; and guiding means for guiding said septum stem into said docking platform.

3. A system according to claim 2, wherein said recharge cartridge further comprises a grooved raised area contoured to fit between a thumb and a forefinger of a human hand.

4. A system according to claim 2, wherein said guiding means is an annular ring engageable with a corresponding slot in said docking platform.

5. A system according to claim 2, wherein said docking platform includes:

a horizontal base portion;

a vertical wall portion at a first end of said horizontal base portion;

a groove in said vertical wall portion effective for receiving said septum stem;

a recessed portion in said horizontal base portion effective for receiving said docking slide, said recessed portion including a plurality of detents therein;

a radial undercut in said horizontal base portion immediately adjacent said vertical wall portion and centered under said groove of said vertical wall portion; and a stress relief rib in said recessed portion substantially orthogonal to said radial undercut.

6. A system according to claim 5, wherein said docking slide includes an integrally molded piece, said integrally molded piece including:

two opposing hooks at a first end of said piece, said hooks being interconnectable with an annular groove on said septum stem;

two opposing projections at a second end of said piece, said projections being interconnectable with two of said plurality of detents; and two opposing handles between said hooks and said projections.

7. A system according to claim 1, wherein said docking slide includes an integrally molded piece, said integrally molded piece including:

two opposing hooks at a first end of said piece;

two opposing projections at a second end of said piece; and two opposing handles between said hooks and said projections.

* * * * *